US006857725B2

(12) United States Patent
Otsuki

(10) Patent No.: US 6,857,725 B2
(45) Date of Patent: Feb. 22, 2005

(54) PRINTING UP TO EDGES OF PRINTING MEDIUM WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 108 days.

(21) Appl. No.: 10/291,759

(22) Filed: Nov. 12, 2002

(65) Prior Publication Data

US 2003/0103101 A1 Jun. 5, 2003

(30) Foreign Application Priority Data

Nov. 12, 2001 (JP) ..... 2001-345776

(51) Int. Cl.[7] ..... B41J 2/21
(52) U.S. Cl. ..... 347/43; 347/41
(58) Field of Search ..... 347/43, 41, 15, 347/40, 12, 37

(56) References Cited

U.S. PATENT DOCUMENTS 4,198,642 A 4/1980 Gamblin
6,464,335 B2 * 10/2002 Suzuki ..... 347/43
6,565,192 B1 * 5/2003 Vinals et al. ..... 347/41

FOREIGN PATENT DOCUMENTS

JP 2000-118058 4/2000

* cited by examiner

*Primary Examiner*—Lamson D Nguyen
(74) *Attorney, Agent, or Firm*—Sughrue Mion, PLLC

(57) ABSTRACT

The printing is performed to the edges of printing paper without depositing ink drops on the platen. The platen 26 of the printer of the present invention comprises, in order from the upstream end in the sub-scanning direction, an upstream support portion 26*sf*, a recessed portion 26*f*, and a downstream support portion 26*sr*. The printer performs printing of the upper edge portion of printing paper using only a nozzle group Nh facing recessed portion 26*f*, and performs printing of the lower edge portion of printing paper using only a second nozzle group Nh facing recessed portion 26*f*. Between printing of the upper edge portion and intermediate portion, there is performed an upper edge transition process wherein printing is performed using all nozzle groups in the same manner as in the intermediate portion, but with the same sub-scan feed as in the upper edge portion. Between printing of the intermediate portion and lower edge portion, there is performed a lower edge transition process wherein printing is performed using all nozzle groups, but with the same sub-scan feed as in the lower edge portion. By performing these transition processes, upper edge processing, intermediate processing and lower edge processing can be performed smoothly without sub-scan back-feed.

28 Claims, 24 Drawing Sheets

PRINTING UP TO EDGES OF PRINTING MEDIUM WITHOUT PLATEN SOILING

BACKGROUND OF THE INVENTION

1. Field of the Invention

This invention relates to a technique for recording dots on the surface of a print medium using a dot recording head, and in particular to a technique for printing to the edges of printing paper without soiling the platen.

2. Description of the Related Art

In recent years, printers that eject ink from nozzles provided in a print head have come to enjoy widespread use as computer output devices. FIG. 24 is a side view depicting the print head and surrounding area in a conventional printer. Printing paper P is supported on a platen 26*o* so as to face head 28*o*. Printing paper P is advanced in the direction indicated by arrow A by means of upstream paper feed rollers 25*p*, 25*q* located upstream from platen 26*o*, and downstream paper feed rollers 25*r*, 25*s* located downstream from platen 26. As the head ejects ink, dots are recorded sequentially on printing paper P to print an image.

In such printers, if it is desired to print an image all the way to the an edge of the printing paper, it becomes necessary to arrange the edge below the print head, i.e. with the printing paper P positioned on the platen, and to then eject drops of ink from the print head. However, when printing is done in this manner, printing paper misfeed, misplacement of ink drop deposit location or the like may in some instances result in ink drops being deposited on the platen, away from the edge of the printing paper where it was desired to do so. In such instances, printing paper subsequently passing over the platen may become soiled by the ink deposited on the platen.

This invention is intended to solve the aforementioned drawback of the prior art, and has as an object to provide a technique for printing to the edges of printing paper without soiling the platen.

SUMMARY OF THE INVENTION

In order to attain at least part of the above objects, according to the present invention there is performed a predetermined process targeted to dot recording devices that records dots on a surface of a print medium using a dot recording head equipped with dot-forming element groups comprising a is plurality of dot-forming elements for ejecting drops of ink. The device comprises: a main scan drive unit which drives the dot recording head and/or the print medium to perform main scanning; a head drive unit which drives at least part of the plurality of dot-forming elements to form dots during the main scan; a platen arranged extending in a direction of the main scan so as to face the plurality of dot-forming elements in at least part of a path of the main scan, and supporting the print medium so as to face the dot recording head; a sub-scan drive unit which drives at intervals between the main scans the print medium in a direction intersecting the direction of the main scan to perform sub-scanning; and a control unit for controlling the main scan drive unit, the head drive unit, and the sub-scan drive unit.

The plurality of dot-forming elements comprises: a first dot-forming element sub-group; and a second dot-forming element sub-group being located downstream from the first dot-forming element sub-group in a direction of the sub-scan. It is preferable that the platen comprises a recessed portion arranged extending in the direction of the main scan at a location facing the second dot-forming element sub-group.

In such an dot recording device, the printing is performed as follows. The surface of the print medium is divided, in order from a top, into an upper edge portion that includes an upper edge, an upper edge transition portion, an intermediate portion, a lower edge transition portion, and a lower edge portion that includes a lower edge. Upper edge printing is performed for forming dots in the upper edge portion. The upper edge printing is performed in an upper edge portion sub-scan mode and performed using the second dot-forming element sub-group and without using the first dot-forming element sub-group. Intermediate printing is performed for forming dots in the intermediate portion. The intermediate printing is performed in an intermediate portion sub-scan mode and performed using the first and second dot-forming element sub-groups. The intermediate portion sub-scan mode has a sub-scan maximum feed distance that is greater than a sub-scan maximum feed distance in the upper edge portion sub-scan mode. Upper edge transition printing is performed for forming dots in the upper edge transition portion. The upper edge transition printing is performed in an upper edge transition portion sub-scan mode and performed using the first and second dot-forming element sub-groups. The upper edge transition portion sub-scan mode has a sub-scan maximum feed distance that is smaller than the sub-scan maximum feed distance in the intermediate portion sub-scan mode.

According to this mode, dots can be formed up to the upper portion of printing paper without depositing ink drops on the platen. Further, smooth transition is possible from forming dots in the upper edge portion with the second dot forming element sub-group to forming dots in the intermediate portion with the first and second dot forming element sub-groups, without sub-scan back-feed.

The platen of the dot recording device may comprise: an upstream support portion for supporting the print medium; a recessed portion; and a downstream support portion for supporting the print medium. The upstream support portion may be arranged to extend in the direction of the main scan at a location facing the first dot-forming element sub-group. The recessed portion may be arranged to extend in the direction of the main scan at a location facing the second dot-forming element sub-group that is located downstream from the first dot-forming element sub-group in a direction of the sub-scan. The downstream support portion may be arranged to extend in the direction of the main scan at a location downstream from the recessed portion in the direction of the sub-scan.

The printing as follows is preferably performed in case that the dot recording head comprises a third dot-forming element sub-group in the plurality of dot-forming elements, and the third dot-forming element sub-group is located downstream from the second dot-forming element sub-group in the direction of the sub-scan and facing the downstream support portion. In the upper edge printing, the upper edge printing is performed without using the third dot-forming element sub-group. In the upper edge transition printing, the upper edge transition printing is performed without using the third dot-forming element sub-group. In the intermediate printing, the intermediate printing is performed further using the third dot-forming element sub-group. According to this mode, printing may be performed more efficiently during intermediate printing through the use of a greater number of nozzles.

The upper edge transition portion sub-scan mode may be equivalent to the upper edge portion sub-scan mode.

According to this mode, it is possible to smoothly transition from upper edge printing to upper edge transition printing.

In forming dots in the upper edge portion, dots may be formed when the print medium is supported by the platen with the upper edge of the print medium located over an opening of the recessed portion. According to this mode, using the second dot forming element sub-group, dots can be formed without blank space at the upper edge of the print medium.

The platen may comprise a recessed portion arranged extending in the direction of the main scan at a location facing the first dot-forming element sub-group. In this mode, the printing as follows is preferably performed.

Intermediate printing is performed for forming dots in the intermediate portion. The intermediate printing is performed in an intermediate portion sub-scan mode and performed using the first and second dot-forming element sub-groups. Lower edge transition printing is performed for forming dots in the lower edge transition portion. The lower edge transition printing is performed in a lower edge transition portion sub-scan mode and performed using the first and second dot-forming element sub-groups. The lower edge transition portion sub-scan mode has a sub-scan maximum feed distance that is smaller than a sub-scan maximum feed distance in the intermediate portion sub-scan mode. Lower edge printing is performed for forming dots in the lower edge portion. The lower edge printing is performed in a lower edge portion sub-scan mode and performed using the first dot-forming element sub-group and without using the second dot-forming element sub-group. The lower edge portion sub-scan mode has a sub-scan maximum feed distance that is smaller than the sub-scan maximum feed distance in the intermediate portion sub-scan mode.

According to this mode, dots can be formed up to the upper portion of printing paper without depositing ink drops on the platen. Further, smooth transition is possible from forming dots in the intermediate portion with the first and second dot forming element sub-groups to forming dots in the lower edge portion with the first dot forming element sub-group, without sub-scan back-feed.

The platen may comprise: a recessed portion; a downstream support portion for supporting the print medium; and an upstream support portion for supporting the print medium. The recessed portion may be arranged to extend in the direction of the main scan at a location facing the first dot-forming element sub-group that comprises a part of the plurality of dot-forming elements. The downstream support portion may be arranged to extend in the direction of the main scan at a location facing the second dot-forming element sub-group that is located downstream from the first dot-forming element sub-group in a direction of the sub-scan. The upstream support portion may be arranged to extend in the direction of the main scan at a location upstream from the recessed portion in the direction of the sub-scan.

The printing as follows is preferably performed in case that the dot recording head comprises a third dot-forming element sub-group in the plurality of dot-forming elements, and the third dot-forming element sub-group is located upstream from the first dot-forming element sub-group in the direction of the sub-scan and facing the upstream support portion. In the intermediate printing, the intermediate printing is performed further using the third dot-forming element sub-group. In the lower edge transition printing, the lower edge transition printing is performed without using the third dot-forming element sub-group. In the lower edge printing, the lower edge printing is performed without using the third dot-forming element sub-group. According to this mode, printing may be performed more efficiently during intermediate printing through the use of a greater number of nozzles.

The lower edge transition portion sub-scan mode may be equivalent to the lower edge portion sub-scan mode. According to this mode, smooth transition is possible from the lower edge transition printing to the lower edge printing.

In forming dots in the lower edge portion, dots may be formed when the print medium is supported by the platen with the lower edge of the print medium located over an opening of the recessed portion. According to this mode, using the first dot forming element sub-group, dots can be formed without blank space at the upper edge of the print medium.

The present invention may be realized in various modes, such as the following.

(1) Dot recording device, dot recording control device, printing device.
(2) Dot recording method, dot recording control method, printing method.
(3) Computer program for realizing an aforementioned device or method.
(4) Recording medium having recorded thereon a computer program for realizing an aforementioned device or method.
(5) Data signal embodied in a carrier wave, including a computer program for realizing an aforementioned device or method.

These and other objects, features, aspects, and advantages of the present invention will become more apparent from the following detailed description of the preferred embodiments with the accompanying drawings.

DESCRIPTION OF THE PREFERRED EMBODIMENTS

The embodiments of the present invention shall be described hereinbelow through working examples given in the following order.

A. Summary of the embodiment

B. Working Example 1

- B1. Overall arrangement of the device
- B2. Relationship of image data and printing paper
- B3. Sub-scan feed during printing C. Working Example 2

D. Working Example 3

E. Variations

- E1. Variation 1
- E2. Variation 2
- E3. Variation 3

A. Summary of the Embodiment

Figure 1:
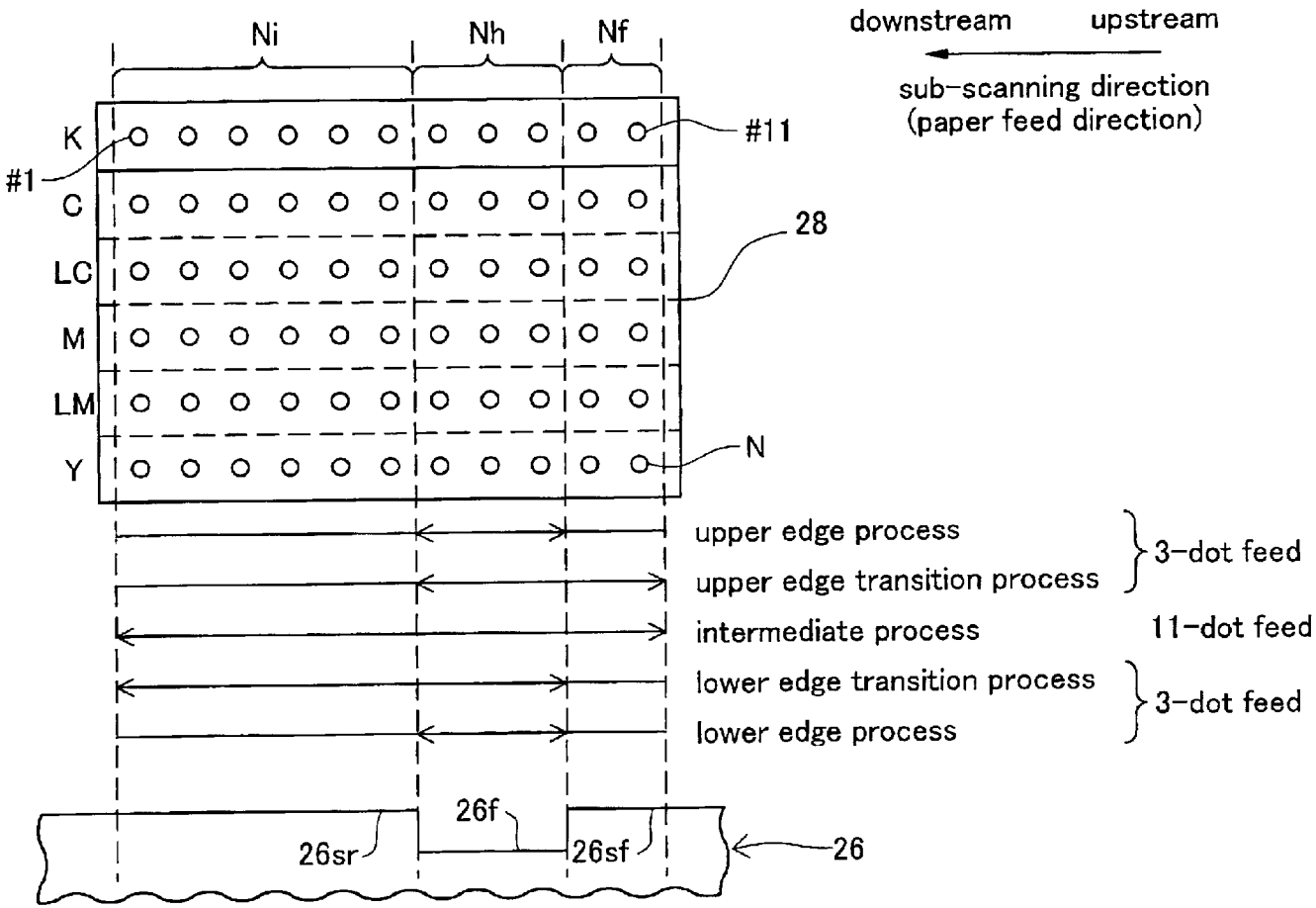
FIG. 1 is a schematic diagram showing changes in nozzle usage for a print head 28 of an ink jet printer pertaining to an embodiment of the present invention.

FIG. 1 is a schematic diagram showing changes in nozzle usage for a print head 8 of an ink jet printer pertaining to an embodiment of the present invention. In FIG. 1, the bottom face of the print head 28 is shown at the top, and the corresponding arrangement of the platen 26 relative to the nozzles of print head 28 is shown in side view. The platen 26 of this printer is provided, in order from the upstream end in the sub-scanning direction, with an upstream support portion 26*fs*, a recessed portion 26*f*, and a downstream support portion 26*sr*. Nozzles provided on the print head 28 facing the platen 26 are divided, in order from the upstream end, into a first nozzle group Nf facing upstream support portion 26*fs*, a second nozzle group Nh facing recessed portion 26*f*, and a third nozzle group Ni facing downstream support portion 26*sr*.

As regards the upper edge of the printing paper, the printer performs printing using only the second nozzle group Nh facing recessed portion 26*f* when the upper edge is located over the recessed portion 26*f* (upper edge process). As regards the lower edge of the printing paper, the printer performs printing using only the second nozzle group Nh facing recessed portion 26*f* when the lower edge is located over the recessed portion 26*f* (lower edge process). By so doing, an image can be printed to the edges of the printing paper without blank space and without soiling the upper surface of the platen 26. The intermediate portion of the printing paper is printed using all of the nozzle groups (intermediate process). Thus, the intermediate portion can be printed rapidly.

Between the upper edge process and the intermediate process, there is performed an upper edge transition process wherein sub-scan feed is the same as the upper edge process, but both nozzle groups Nf and Nh are used for printing. Then, between the intermediate process and the lower edge process, there is performed a lower edge transition process wherein sub-scan feed is the same as the lower edge process, but both nozzle groups Nh and Ni are used for printing. In other words, nozzle group Ni is not used in the upper edge transition process, and nozzle group Nf is not used in the lower edge transition process. By performing these transition processes it is possible to perform the upper edge process, intermediate process and lower edge process smoothly, without sub-scan back-feed or alignment feed by a large feed distance. Print quality is improved as a result.

B. Working Example 1

B1. Overall Arrangement of the Device

Figure 2:
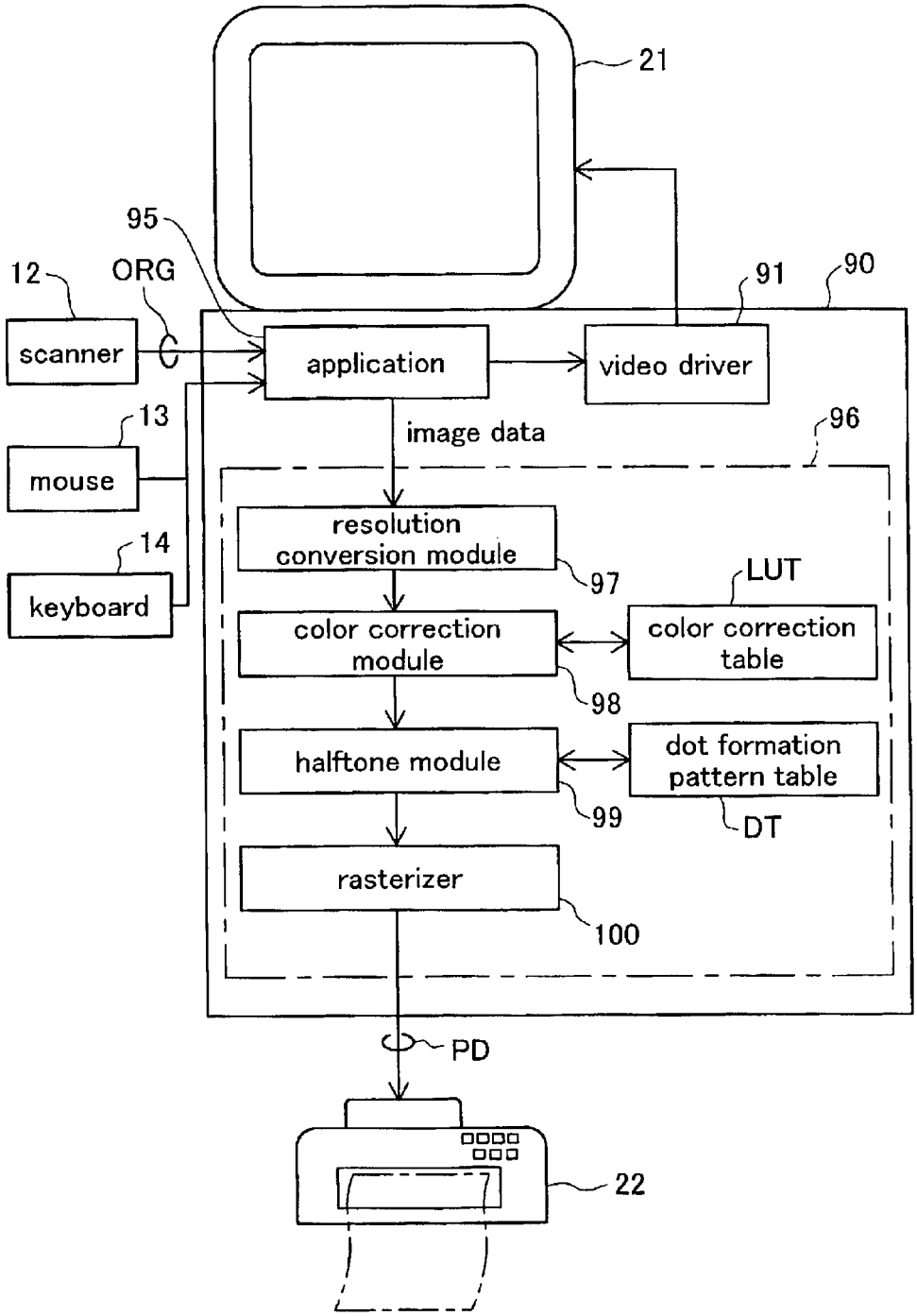
FIG. 2 is a block diagram showing the software arrangement of the printing device.

FIG. 2 is a block diagram showing the software arrangement of the printing device. On a computer 90, an application program 95 is run on a predetermined operating system. The operating system includes a video driver 91 and printer driver 96, whereby the application program 95, via these drivers, is able to output image data D for transfer to printer 22. Application 95, which performs image retouching and the like, reads in an image from a scanner 12 and displays it on a CRT 21 via the video driver 91 while performing predetermined processing thereof. Data ORG supplied by scanner 22 is read from a color original, and consists of primary color data ORG composed of three color components, red (R), green (G) and blue (B).

When the application program 95 issues a print command in response to input of an instruction from a mouse 13 or keyboard, the printer driver 96 of computer 90 fetches the image data from the application program 95 and converts it to a signal processable by the printer 22 (here, a signal containing multilevel values for the colors cyan, magenta, light cyan, light magenta, yellow and black). In the example illustrated in FIG. 2, the printer driver 96 includes a resolution conversion module 97, a color correction module 98, a halftone module 99, and a rasterizer 100. Also held in memory are a color correction table LUT and a dot formation pattern table DT.

Color conversion module 97 performs the function of converting the resolution of color image data handled by the application program 95, i.e. the number of pixels per unit of length, to a resolution that can be handled by the printer driver 96. As the resolution-converted image data still consists of image information for three colors (RGB), color correction module 98 then converts it, on a per-pixel basis with reference to color correction table LUT, to data for each of the colors used by the printer, i.e. cyan (C), magenta (M), light cyan (LC), light magenta (LM), yellow (Y) and black (K).

The color-corrected data will have a grayscale of 256 levels, for example. The halftone module 99 executes a halftone process such that the printer 22 can reproduce these levels by forming dots dispersedly. By referring to the dot formation pattern table DT, halftone module 99 executes the halftoning process upon setting the dot formation pattern for each ink dot depending on image data level. This processed image data is sorted by rasterizer 100 in the order in which it will be sent to the printer, and finally output as print data PD. Print data PD includes raster data indicating dot recording mode during each main scan, and data indicating the sub-scan feed distance. In this example, printer 22 only performs the function of forming the ink dots and does not perform any image processing, but naturally this process could be performed by the printer 22 as well.

Figure 3:
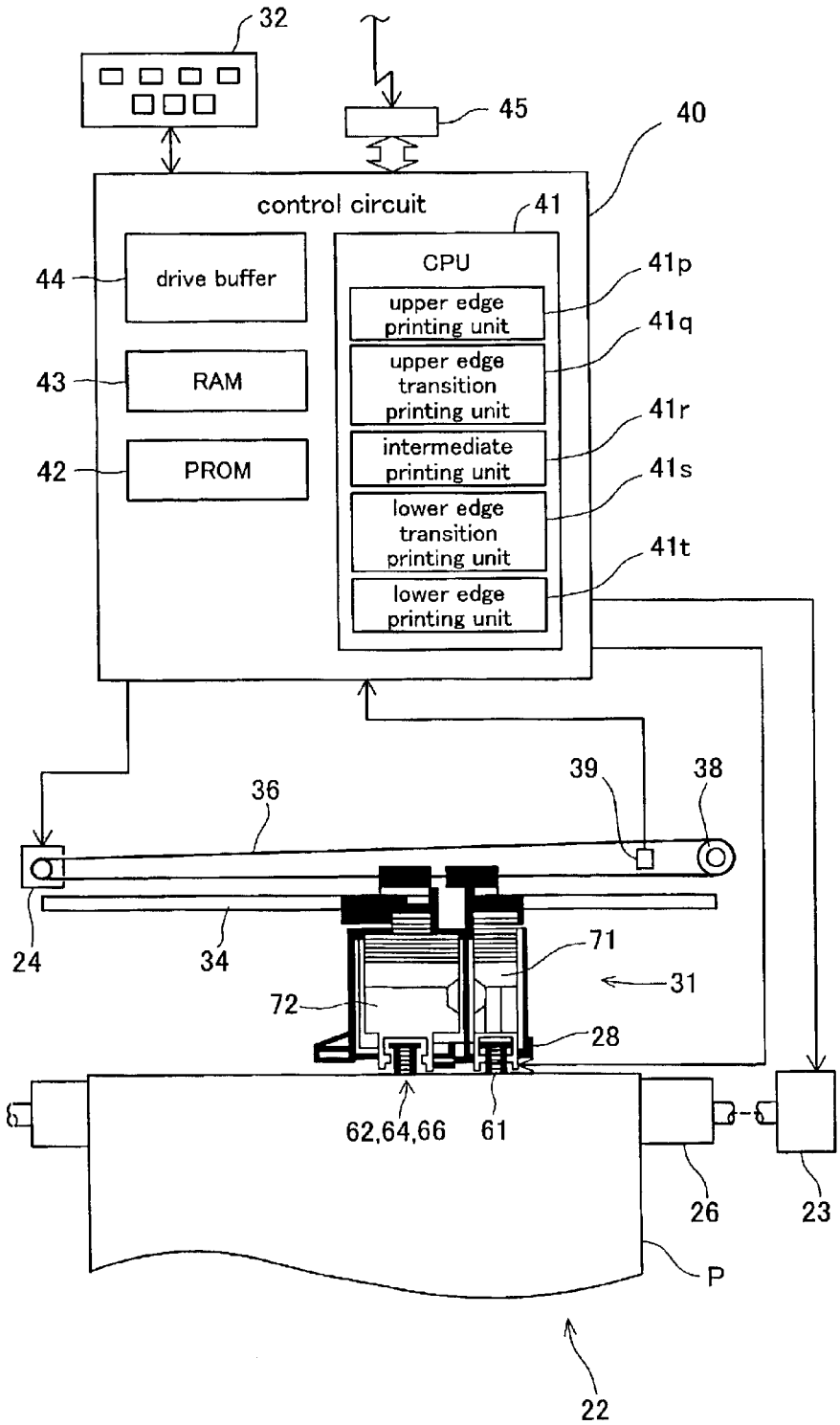
FIG. 3 is a schematic diagram showing the general arrangement of printer 22.

The general arrangement of printer 22 is shown in FIG. 3. As shown in the drawing, this printer 22 comprises a mechanism for transporting paper P by means of a paper feed motor 23; a mechanism for reciprocating a carriage 31 in the axial direction of a slide bar 34 by means of a carriage motor 24; a mechanism for ejecting ink and forming ink dots by driving a print head 28 carried on carriage 31; and a control circuit 40 for exchanging signals with the paper feed motor 23, carriage motor 24, print head 28 and a control panel 32.

The mechanism for reciprocating carriage 31 in the axial direction of platen 26 comprises a pulley 38 having an endless belt 36 that extends between the carriage motor 24 and the pulley 38: the slide bar 34 extending in the perpendicular direction to the printing paper P feed direction and slidably retaining the carriage 31; and a position sensor 39 for sensing the home position of carriage 31.

Attachable to carriage 31 is a black ink (K) cartridge 71 and a color ink cartridge 72 containing inks of five colors, cyan (C), magenta (M), light cyan (LC), light magenta (LM), and yellow (Y). On the ink head 28 at the bottom of carriage 31 are formed a total of six ink eject heads 61 to 66, and when the black ink (K) cartridge 71 and color ink cartridge 72 are installed on the carriage 31 from above, ink can be supplied from the ink cartridges to the ink eject heads 61 to 66.

Figure 4:
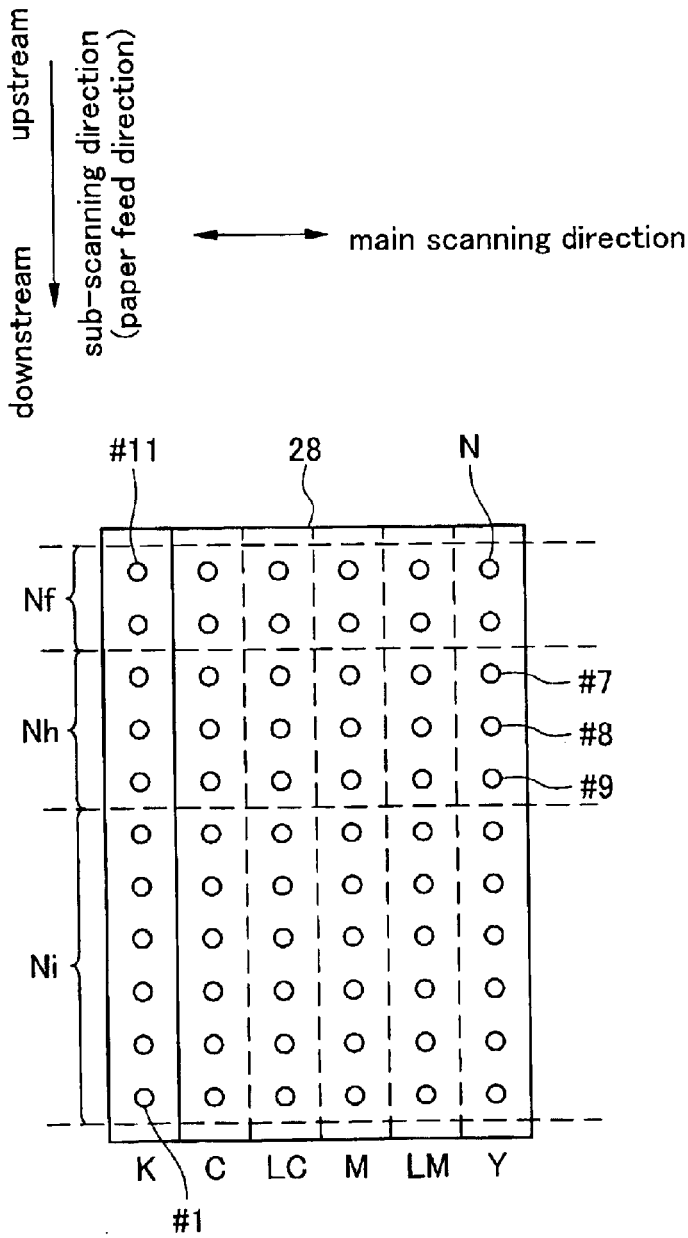
FIG. 4 is a schematic diagram showing the example of the ink nozzle arrangement in print head 28.

FIG. 4 is a schematic diagram showing the ink nozzle arrangement in print head 28. Nozzles are arranged in six nozzle arrays, each of which ejects ink of one of the colors black (K), cyan (C), magenta (M), light cyan (LC), light magenta (LM), or yellow (Y), these 48 nozzles being arranged in rows a given nozzle pitch k apart. The six nozzle arrays are arranged so as to line up in the main scanning direction. More specifically, the nozzles in each individual nozzle array are arranged lined up on the same given main scan line. These nozzle arrays (nozzle rows) correspond to the "dot-forming element groups" recited in the claims. "Nozzle pitch" herein refers to a value indicating the sub-scanning direction interval between nozzles arranged on the print head, expressed as the number of main scan lines (i.e. expressed as pixels). For example, nozzles arranged at a 3-line interval would have nozzle pitch k of 4. "Main scan line" herein refers to a row of pixels lined up in the main scanning direction. "Pixel" herein refers to a grid cells hypothetically established on the print medium (or in some instances outside the margins of the print medium) to prescribe a location for depositing an ink drop to record a dot. FIG. 4 shows placement of the nozzles in general form only, and does not accurately reflect head dimensions and the number of nozzles in the example.

The nozzles within each nozzle array are divided, in order from the upstream end in the sub-scanning direction, into three sub-groups. These sub-groups correspond to the "dot forming element sub-groups" recited in the claims. The nozzle array sub-groups are designated, in order from the upstream end in the sub-scanning direction, as nozzle groups Nf, Nh and Ni. Herein, the dot forming element sub-groups of each nozzle array shall be referred to collectively as nozzle groups Nf, Nh and Ni. Nozzle groups are established so as to correspond to parts of the platen 26, i.e. the recessed portion, support portions etc., provided at locations facing the print head in main scanning. Correspondence of parts of the platen 26, i.e. the recessed portion, support portions, and the nozzle groups shall be discussed later.

Figure 5:
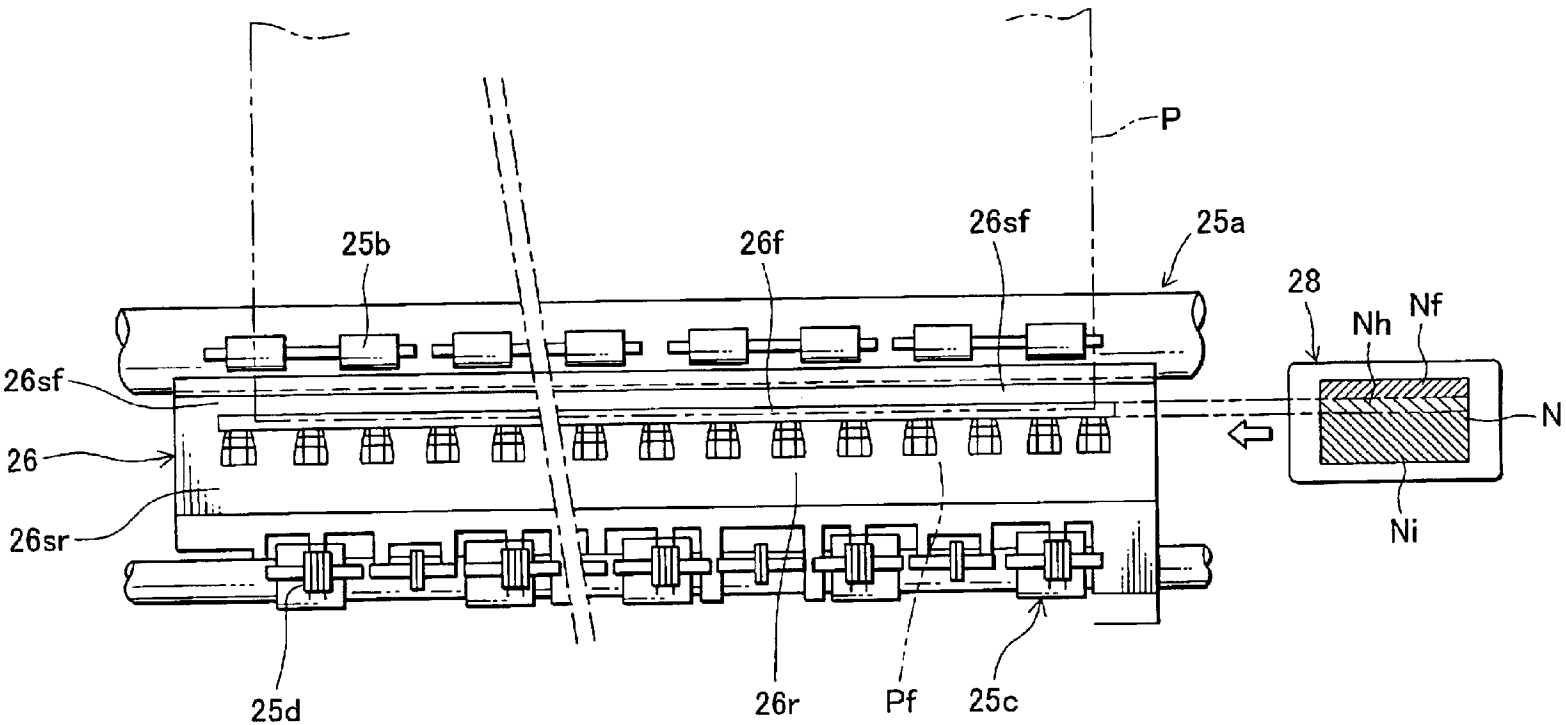
FIG. 5 is a plan view of the area around the platen 26.

FIG. 5 is a plan view of the area around the platen 26. Platen 26 has greater length in the main direction than does the maximum width of printing paper P that can be used in printer 22. At the upstream end of platen 26 are provided upstream paper feed rollers 25*a*, 25*b*. While upstream paper feed roller 25*a* consists of a single drive roller, upstream paper feed roller 25*b* is composed of a plurality of freely rotating small roller. At the downstream end of platen 26 are provided downstream paper feed rollers 25*c*, 25*d*. Downstream paper feed roller 25*c* is composed of a plurality of roller on a drive spindle, and downstream paper feed roller 25*d* is composed of a plurality of freely rotating small roller. Downstream paper feed roller 25*d* has radial "teeth" (portions lying between adjacent recesses) on its outside peripheral face and has the appearance of a gear shape when viewed from the direction of the rotation axis. This downstream paper feed roller 25*d* is commonly known as a "serrated roller" and has the function of pressing the printing paper P against the platen 26. The downstream paper feed roller 25*c* and upstream paper roller 25*a* turn in sync so that their peripheral speed is equal.

During main scanning, print head 28 reciprocates over the platen 26 between the upstream paper feed rollers 25*a*, 25*b* and downstream paper feed rollers 25*c*, 25*d*. Printing paper P is retained by upstream paper feed rollers 25*a*, 25*b* and downstream paper feed rollers 25*c*, 25*d*, with the portion therebetween supported by the upper surface of the platen 26 so as to face the nozzle arrays of the print head 28. As the sub-scan feeds are performed by upstream paper feed rollers 25*a*, 25*b* and downstream paper feed rollers 25*c*, 25*d*, an image is recorded sequentially thereon by means of ink ejected from the nozzles of the print head 28.

Platen 26 is provided with a recessed portion 26*f* that has greater length in the main direction than does the maximum width of printing paper P that can be used in printer 22. In the bottom portion of the recessed portion 26*f* is arranged an absorbent member 27*f* for receiving and absorbing ink drops Ip. The portion of platen 26 upstream from recessed portion

26*f* shall be termed upstream support portion 26*sf*. The portion of platen 26 downstream from recessed portion 26*f* shall be termed downstream support portion 26*sr*.

The following description proceeds in order from the upstream end in the sub-scanning direction. Upstream support portion 26*sf* extends in the main scanning direction at a location facing the first nozzle group Nf which consists of those nozzles of print head 28 that are furthest towards the upstream end. This upstream support portion 26*sf* has a flat upper face. Next, recessed portion 26*f* extends in the main scanning direction at a location facing the second nozzle group Nh which is located downstream from the first nozzle group Nf. Finally, downstream support portion 26*sr* extends in the main scanning direction at a location facing the third nozzle group Ni which is located downstream from the second nozzle group Nh. In the print head 28 illustrated in FIG. 5, nozzle groups Nf, Nh and Ni are shown by portions hatched by diagonal lines in different directions at different intervals.

The internal arrangement of control circuit 40 (see FIG. 3) of printer 22 is now described. Within control circuit 40 are provided a CPU 41, PROM 42 and RAM 43, as well as a PC interface 45 for exchange of data with computer 90, a drive buffer 44 for outputting ink dot ON/OFF signals to ink eject heads 61–66, and the like, these elements and circuits being interconnected via a bus. Control circuit 40 receives dot data processed by computer 90 and temporarily stores it in RAM 43, from which it is output under predetermined timing to drive buffer 44.

Printer 22 having the hardware configuration described above advances the paper P by means of paper feed motor 23 while reciprocating the carriage 31 by means of the carriage motor 24, at the same time driving the piezo elements of the nozzle units of print head 28 to eject ink drops Ip of each color, thereby forming ink dots to produce a multicolor image on paper P.

In a first image printing mode, described later, in order to print the upper edge Pf of printing paper P over the recessed portion 26*f* and to print the lower edge Pr over the recessed portion 26*f*, a specific printing process is performed in the upper edge and lower edge portions of the printing paper P that is different from the printing process for the intermediate portion of the printing paper. Herein, the printing process for the intermediate portion of the printing paper shall be termed "intermediate process", the printing process for the upper edge portion of the printing paper shall be termed "upper edge process", and the printing process for the lower edge portion of the printing paper shall be termed "lower edge process". The upper edge process and lower edge process shall collectively be referred to as "upper/lower edge processes". The printing process performed between the "upper edge process" and "intermediate process" shall be termed the "upper edge transition process" and the printing process performed between the "intermediate process" and "lower edge process" shall be termed the "lower edge transition process".

Width W of recessed portion 26*f* in the sub-scanning direction may be given by the following equation.

$$Wi=p\times n+\alpha$$

Here, p is feed distance of a single sub-scan feed in upper/lower edge processes. n is the number of sub-scan feeds performed in an upper edge process or lower edge process. $\alpha$ is hypothetical sub-scan feed error in an upper edge process or lower edge process. In preferred practice respective Wi values will be calculated for the upper edge process or lower edge process using the above equation, and the larger of the two will be selected as the width W of the recessed portion 26*f* in the sub-scanning direction. By establishing the width of the recessed portion of the platen using the above equation, it becomes possible to provide a recessed portion having width just sufficient to fully receive ink drops ejected from nozzles during upper/lower edge processes. Since error is cumulative through the printing operation, it is likely that the value of error a for a lower edge process will be greater than the value of error $\alpha$ for an upper edge process.

B2. Relationship of Image Data and Printing Paper

Figure 6:
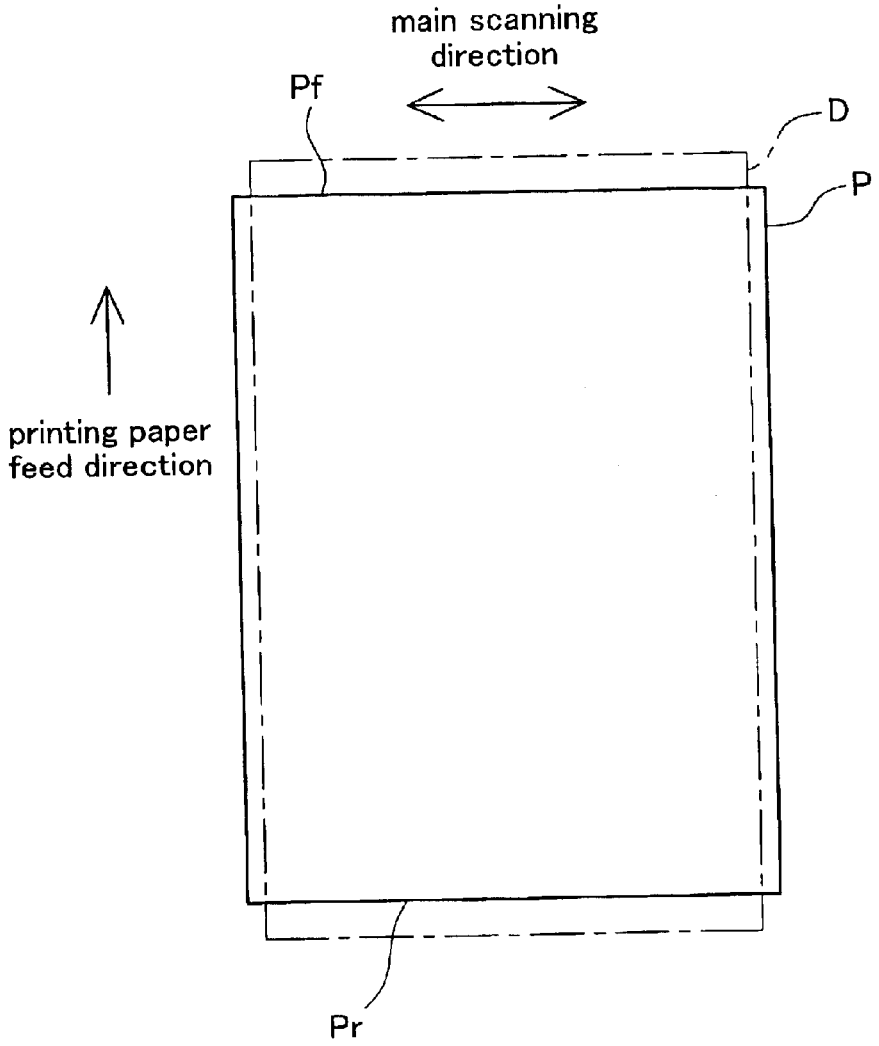
FIG. 6 is a plan view showing the relationship of image data D and printing paper P.

FIG. 6 is a plan view showing the relationship of image data D and printing paper P. In Working Example 1, image data D is set extending beyond the upper edge Pf of printing paper P to the outside of printing paper P. Similarly, at the lower edge as well, image data D is set extending beyond the lower edge Pr of printing paper P to the outside of printing paper P. Accordingly, in Working Example 1, relationships of sizes of image data D and printing paper P, and of positioning of image data D and printing paper P are as shown in FIG. 6.

Herein the terms "upper edge (portion)" and "lower edge (portion)" shall be used when referring to edges of printing paper P in relation to upper/lower direction of image data recorded on printing paper P, and the terms "leading edge (portion)" and "trailing edge (portion)" shall be used when referring to edges of printing paper P in relation to the direction of advance with sub-scan feed of printing paper P on printer 22. Herein, the "upper edge (portion)" in printing paper P corresponds to the "leading edge (portion)", and the "lower edge (portion)" corresponds to the "trailing edge (portion)".

Figure 7:
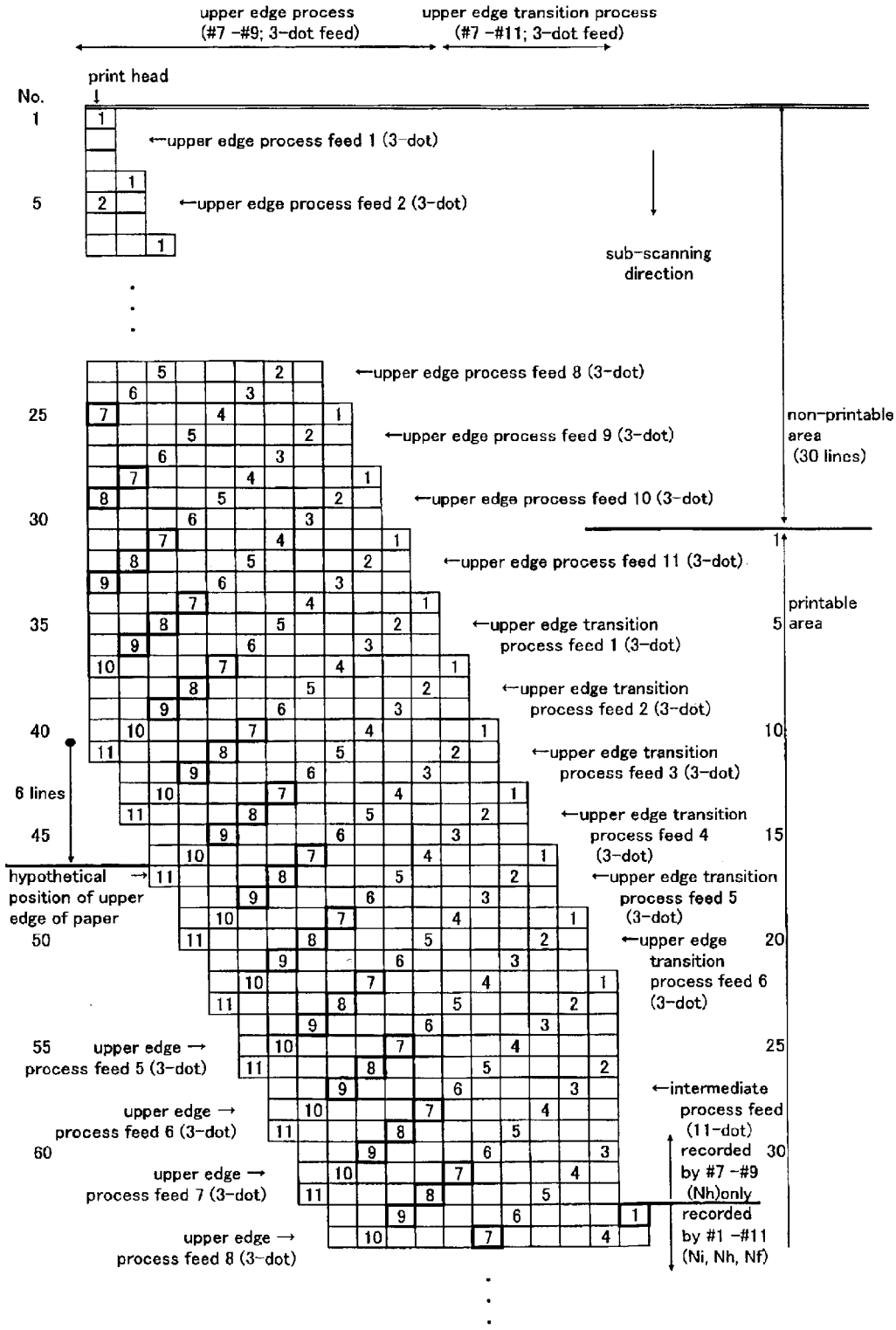
FIG. 7 is a schematic diagram showing how main scan lines are recorded by which nozzles in the upper edge (distal edge) of the printer paper.

B3. Sub-scan Feed During Printing (1) Upper Edge Process, Upper Edge Transition Process and Intermediate Process FIG. 7 is a schematic diagram showing how main scan lines are recorded by which nozzles in the upper edge (distal edge) of the printing paper. Here, the discussion shall be simplified by discussing only one nozzle row. The one nozzle row has 11 nozzles each spaced apart at intervals equivalent to three main scan line. However, the nozzles used for the upper edge process consist only of three nozzles downstream in the sub-scanning direction.

In FIG. 7, the single row of cells lined up longitudinally indicates the print head 28. The numbers 1–11 appearing in cells indicate assigned nozzle number. Herein, these numbers are prefixed by the "#" to indicate nozzles. In FIG. 7, print head 28, which is advanced relatively in the sub-scanning direction over time, is shown being progressively displaced from left to right. Nozzles surrounded by thick borders are the nozzles used in each process.

As shown in FIG. 7, in the upper edge process, only nozzles #7–#9 are used. Herein, "nozzles #n1–#n2 are used" means that "each of the nozzles #n1–#n2 may be used as needed". Accordingly, it is acceptable for only some of the nozzles of the nozzle group consisting of nozzles #n1–#n2 to be used, and other nozzles not used, depending on the data of the image being printed, and the combination of nozzles passing over the main scan line. In certain processes, "nozzles #n3–#n4 are not used" means that nozzles #n3–#n4 are never used during the process.

In the upper edge process, advance by 3 dots in the sub-scanning direction is repeated eleven times. This 3-dot sub-scan feed corresponds to the "upper edge portion sub-scan mode" recited in the claims. The "dot" which is the unit of sub-scan feed means a one-dot pitch corresponding to print resolution in the sub-scanning direction, and is equivalent to main scan line pitch as well. The area of the printing paper P recorded during eleven iterations of advance by 3 dots (see FIG. 7) corresponds to the "upper edge portion" recited in the claims.

When sub-scan feed is carried out in the above manner, each main scan line is recorded by a single nozzle, with the exception of some of the main scan lines. For example, in FIG. 7, the 31st main scan line from the top is recorded by nozzle #7. The 32nd main scan line from the top is recorded by nozzle #8.

In FIG. 7, the 25th main scan line from the top is the uppermost main scan line passed across by the nozzles used in the upper edge process. However, nozzles do not pass over the 26th, 27th and 30th main scan lines from the top in main scanning during printing. Therefore, for these main scan lines, dots cannot be formed at pixels by the nozzles. Thus, in first image printing mode, the main scan lines down to the 30th line from the top are not used for image recording. That is, of the main scan lines recordable as dots by the nozzles on print head 28, the main scan lines enabled for use in image recording in first image printing mode are the 31st and subsequent to main scan lines from the upstream edge in the sub-scanning direction. The area of main scan lines that can be used to record an image is termed the "printable area". The area of main scan lines that cannot be used to record an image is termed the "non-printable area". In FIG. 7, the numbers are shown in the left side of the drawings which are assigned in order from the top to main scan lines recordable by dots from nozzles on print head 28. This convention is used in subsequent drawings describing recording of dots in the upper edge process.

Figure 8:
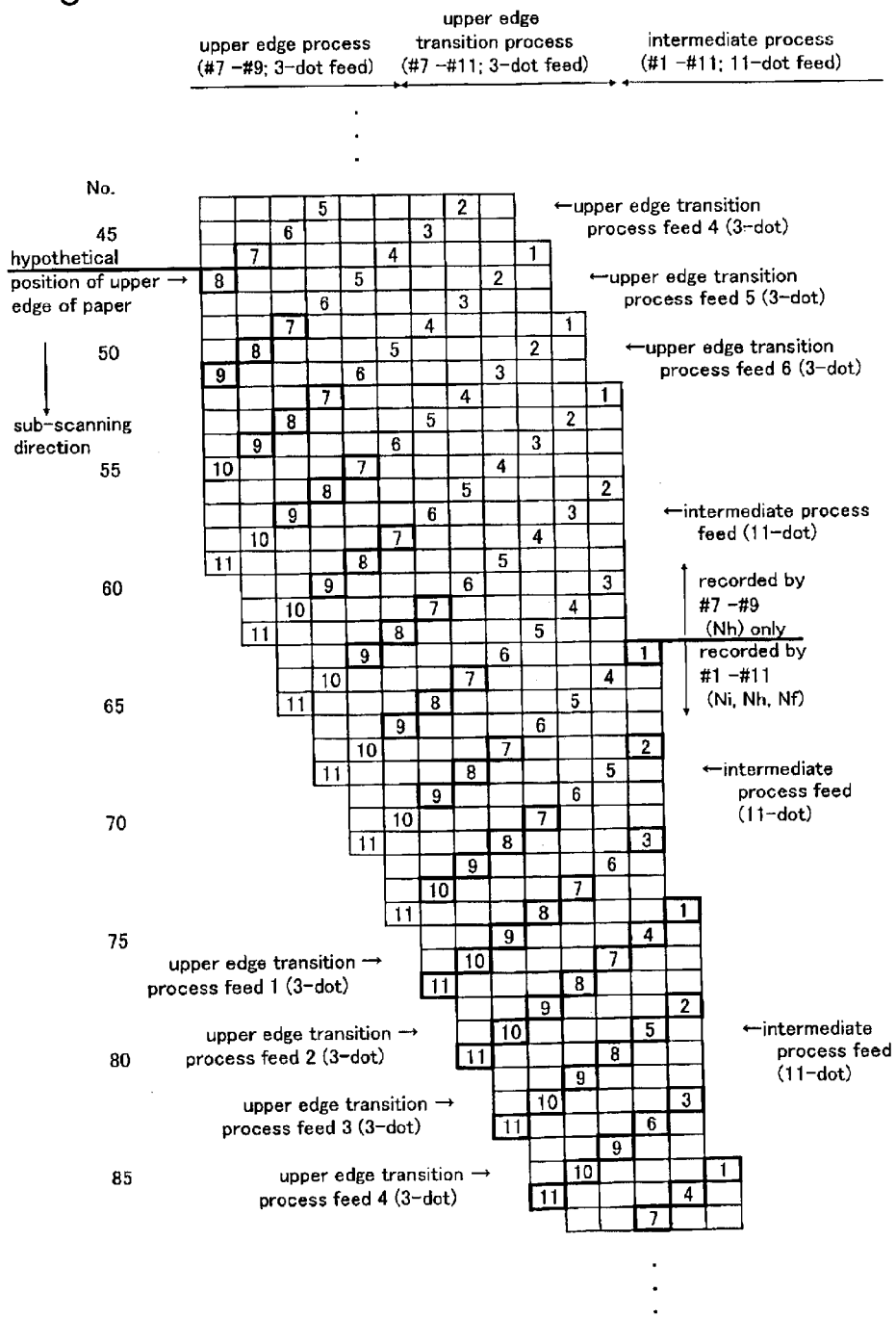
FIG. 8 is a schematic diagram showing how main scan lines are recorded by which nozzles in the upper edge process, upper edge transition process and intermediate process.

FIG. 8 is a schematic diagram showing how main scan lines are recorded by which nozzles in the upper edge process, upper edge transition process and intermediate process. After performing the upper edge process, printer 22 now performs the upper edge transition process using nozzles #7–#11. In the upper edge transition process, as in the upper edge process, sub-scan feed is 3 dots, here repeated six times. This 3-dot sub-scan feed corresponds to the "upper edge transition portion sub-scan mode" recited in the claims. The area of the printing paper P recorded during six iterations of advance by 3 dots (see FIG. 8) corresponds to the "upper edge transition portion" recited in the claims.

After the upper edge transition process, constant (11-dot) feed is performed using nozzles #1–#11 to transition to the intermediate process for dot recording. This format by which sub-scanning is performed by a constant feed distance is termed "constant feed". This 11-dot sub-scan feed corresponds to the "intermediate portion sub-scan mode" recited in the claims. The area of the printing paper P recorded during 11-dot advance (see FIG. 8) corresponds to the "intermediate portion" recited in the claims.

In FIG. 8, the 63rd and 67th main scan lines from the top are passed across twice by the nozzles used in each of the processes. These main scan lines passed across two or more times by nozzles are recorded dots during one of these times from the upper edge process through the intermediate process. Here, dots are assumed to be recorded by nozzles during the final pass of the nozzles across the main scan line. It is preferable that these main scan lines will be recorded by nozzles passing across the main scan lines after the transition to the upper edge transition process or intermediate process, if that is possible. During the upper edge transition process and intermediate process a larger number of nozzles are used as compared to the upper edge process. Thus, the characteristics of a small number of nozzles will not be reflected in the printed result, thereby giving a printed result of high quality.

As a result of printing in the manner described above, the area extending from the 31st main scan line to the 62nd main scan line (counting from the uppermost main scan line on which the print head can record dots) is recorded by nozzles #7, #8 and #9 only (i.e. the second nozzle group Nh). The 63rd and subsequent main scan lines are recorded using nozzles #1–#11 (nozzle groups Ni, Nh, Nf). The relationship of main scan lines and printing paper P and the effects thereof are described hereinbelow.

In Working Example 1, an image is recorded to the top edge of the printing paper without any blank space. As mentioned earlier, in Working Example 1 the image can be recorded using the 31st and subsequent main scan lines from the upstream edge in the sub-scanning direction (printable area) of the main scan lines on which dots are recordable by the nozzles on the print head 28 (see FIG. 7). Accordingly, for recording the image all the way up to the upper edge of the printing paper, recording of dots may commence theoretically with the printing paper P positioned relative to the print head 28 in such a way that the 31st main scan line from the upper edge is positioned at a location close to the upper edge of the printing paper. However, feed distance error during sub-scan feed may occur in some instances. Also, in some instances there may be deviation in the direction of ejection of ink drops due to print head production error etc. It is desirable to avoid blank space occurring at the upper edge of the printing paper even where there is deviation in ink drop deposit location on the printing paper for reasons such as the preceding. Accordingly, in the first image printing mode, image data D used for printing is set starting from the 31st main scan line (counting from the upstream edge in the sub-scanning direction) of the main scan lines on which dots are recordable by the nozzles on the print head 28, while printing commences when the upper edge of printing paper P is positioned at the location of the 47th main scan line from the upstream edge in the sub-scanning direction. Thus, as shown in FIG. 7, the hypothetical position of the upper edge of the printing paper relative to the main scan lines when printing commences is the location of 47th main scan line from the upstream edge in the sub-scanning direction. That is, in Working Example 1, the width of the portion of the image data D is equivalent to 16 lines which is set extending beyond the upper edge Pf of printing paper P to the outside of printing paper P (see FIG. 6). On the other hand, the width of another portion of the image data D is equivalent to 24 lines which is set extending beyond the lower edge Pr of printing paper P to the outside of printing paper P. Main scan lines at the lower edge are described later.

Figure 9:
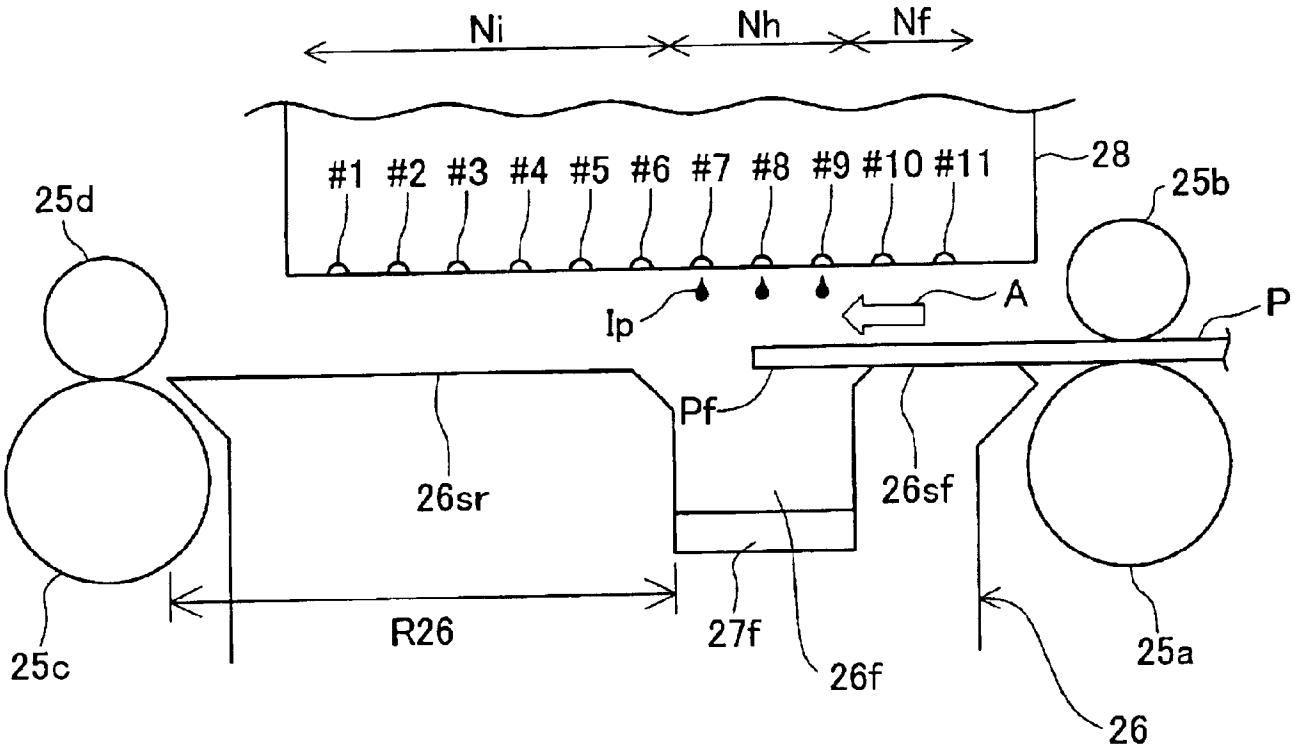
FIG. 9 is a side view showing the relationship of the printing paper P to the print head 28 while performing the upper edge process.

FIG. 9 is a side view showing the relationship of the printing paper P to the print head 28 while performing the upper edge process. Recessed portion 26*f* is provided over a range extending from a position one line downstream counting from nozzle #7, to a position 2 lines upstream counting from nozzle #9. Thus, even if ink drops Ip are expelled from each nozzle in the absence of printer paper, ink drops from nozzles #7, #8 and #9 are deposited on the recessed portion. In other words, ink drops ejected from the nozzles will not become deposited on the upstream support portion 26*sf* and the downstream support portion 26*sr* of the platen 26.

As noted earlier, at the time that printing commences, the upper edge Pf of printing paper P is positioned at the location of the 47th main scan line of the main scan lines on which dots are recordable by the nozzles on the print head 28. The number of 47 is counted from the upstream edge of the recordable main scan lines in the sub-scanning direction. To describe in terms of FIG. 7, the upper edge of printing paper P is positioned at a location six lines upstream (downward in FIG. 7) counting from nozzle #11. When printing commences in this state, while theoretically the 3rd main scan line from the top of the printable area (33rd main scan line from the top in FIG. 7) should be printed by nozzle #9, printing paper P is in fact not yet positioned below nozzle #9. Accordingly, if the printing paper P has been advanced correctly by the upstream paper feed rollers 25*a*, 25*b*, ink drops Ip ejected from nozzle #9 will fall into recessed portion 26*f*. This will be true also where main scan lines down to the 16th line from the top of the printable area (in FIG. 7, main scan lines down to the 46th line from the top) are recorded.

However, where for some reason printing paper P advances by a greater distance than the regular feed distance, the upper edge of printing paper P may be positioned at the location of the 46th main scan line from the top or the location of a main scan line thereabove. In Working Example 1, nozzles #7, #8 and #9 eject ink drops Ip onto these main scan lines, thus enabling the image to be recorded and avoiding blank space at the upper edge of printing paper P even under these circumstances. In other words, even where printing paper P advances by a greater distance than the regular feed distance, blank space at the upper edge of printing paper P is avoided where the excess feed distance does not exceed 16 lines.

Conversely, it is also conceivable that for some reason printing paper P may advance by a lesser distance than the regular feed distance. Under such circumstances, the printing paper will not be present at the location where it normally should be, so ink drops Ip become deposited on the underlying structure. However, as shown in FIGS. 7 and 8, in the first image recording mode, the 16 lines from a hypothetical upper edge location of the paper (in FIG. 8, to the 62nd main scan line) are recorded by nozzles #7, #8 and #9. The recessed portion 26*f* is provided below these nozzles, so if ink drops Ip cannot be deposited on the printing paper P, the ink drops Ip instead fall into the recessed portion 26*f* and are absorbed by the absorbent member 27*f*.

Accordingly, it is possible to avoid depositing of ink drops Ip onto the upper face of the platen 26 and subsequent soiling of printer paper. That is, in Working Example 1, even if the upper edge Pf of the printing paper P should be positioned rearwardly from the hypothetical upper edge location, depositing of ink drops Ip onto the upper face of the platen 26 and subsequent soiling of printing paper P may be avoided where deviation from the hypothetical upper edge location does not exceed 16 lines.

Additionally, in Working Example 1, all nozzles are used for printing in the intermediate process. Thus, high speed printing is possible in the intermediate process.

Further, in Working Example 1, only nozzle groups Nh and Nf (nozzles #7–#11) are used in the upper edge transition process which follows the upper edge process and precedes the intermediate process. That is, the process does not use the third nozzle group Ni (nozzles #1–#6) situated downstream from the second nozzle group Nh used in upper edge processing. This enables smooth transition from the upper edge process to the intermediate process without back-feed in sub-scanning. Printed result quality is therefore higher.

The advantages described hereinabove are achieved, in printing of the upper edge of the printing paper P, by ejecting ink drops from at least part of the second nozzle group Nh (second dot forming element sub-group) to form dots on the printing paper P while the upper edge of the printing paper P is positioned over the opening of the recessed portion.

As described previously, CPU 41 (see FIG. 3) performs the upper edge process with the second nozzle group Nh (nozzles #7, #8, #9), the upper edge transition process with nozzle groups Nh, Nf (nozzle #7–#11) and the intermediate process with nozzle groups Ni, Nh, Nf (nozzle #1–#11). That is, CPU 41 functions as the "upper edge printing unit", "upper edge transition printing unit" and "intermediate printing unit" recited in the claims. These functional portions of CPU 41 are shown in FIG. 3 as upper edge printing unit 41*p*, upper edge transition printing unit 41*q* and "intermediate printing unit 41*r*.

(2) Lower Edge Transition Process and Lower Edge Process

Figure 10:
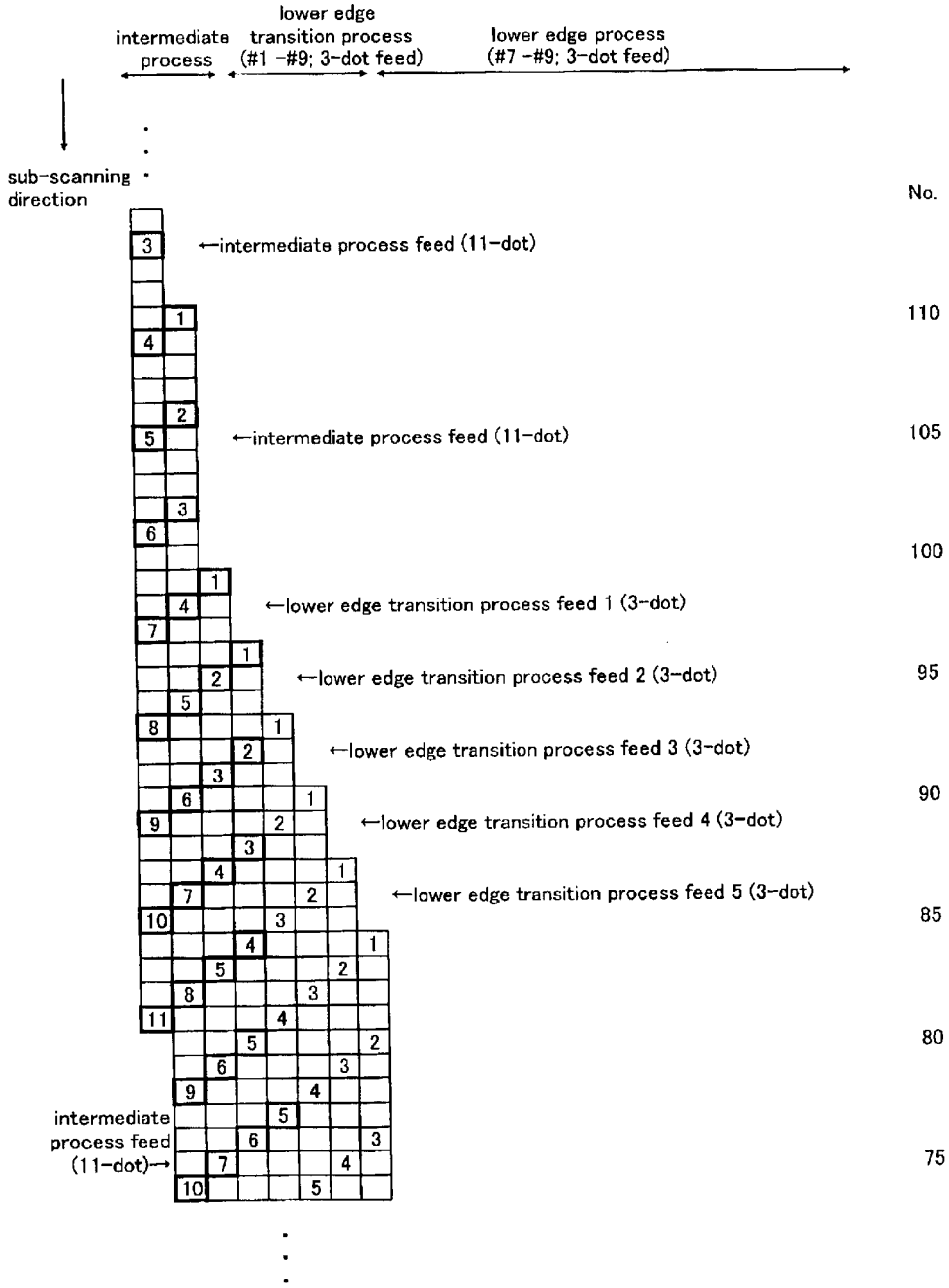
FIG. 10 is a schematic diagram showing how main scan lines are recorded by which nozzles in the intermediate process and lower edge transition process.
Figure 11:
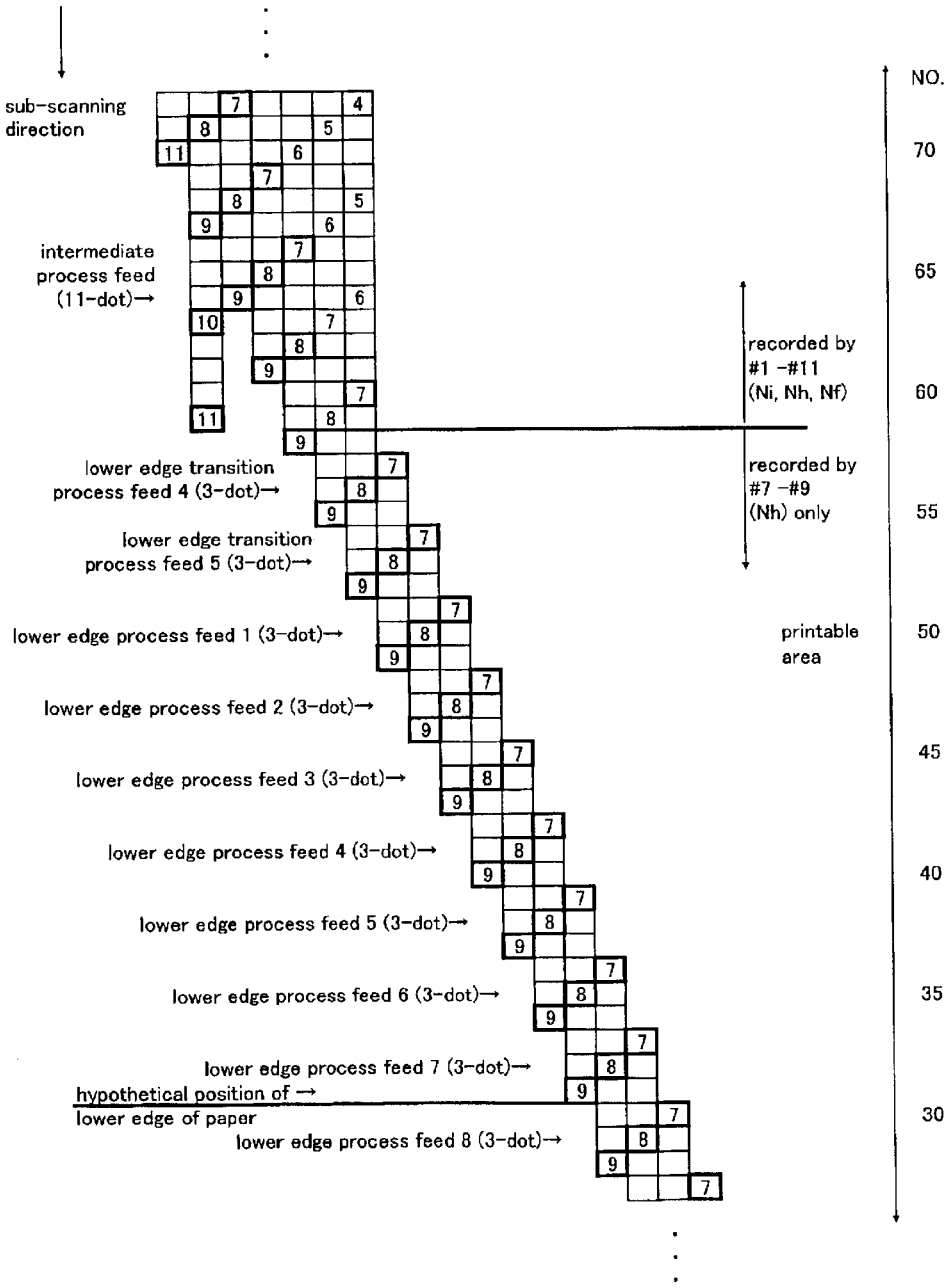
FIG. 11 is a schematic diagram showing how main scan lines are recorded by which nozzles in the intermediate process, lower edge transition process and lower edge process.
Figure 12:
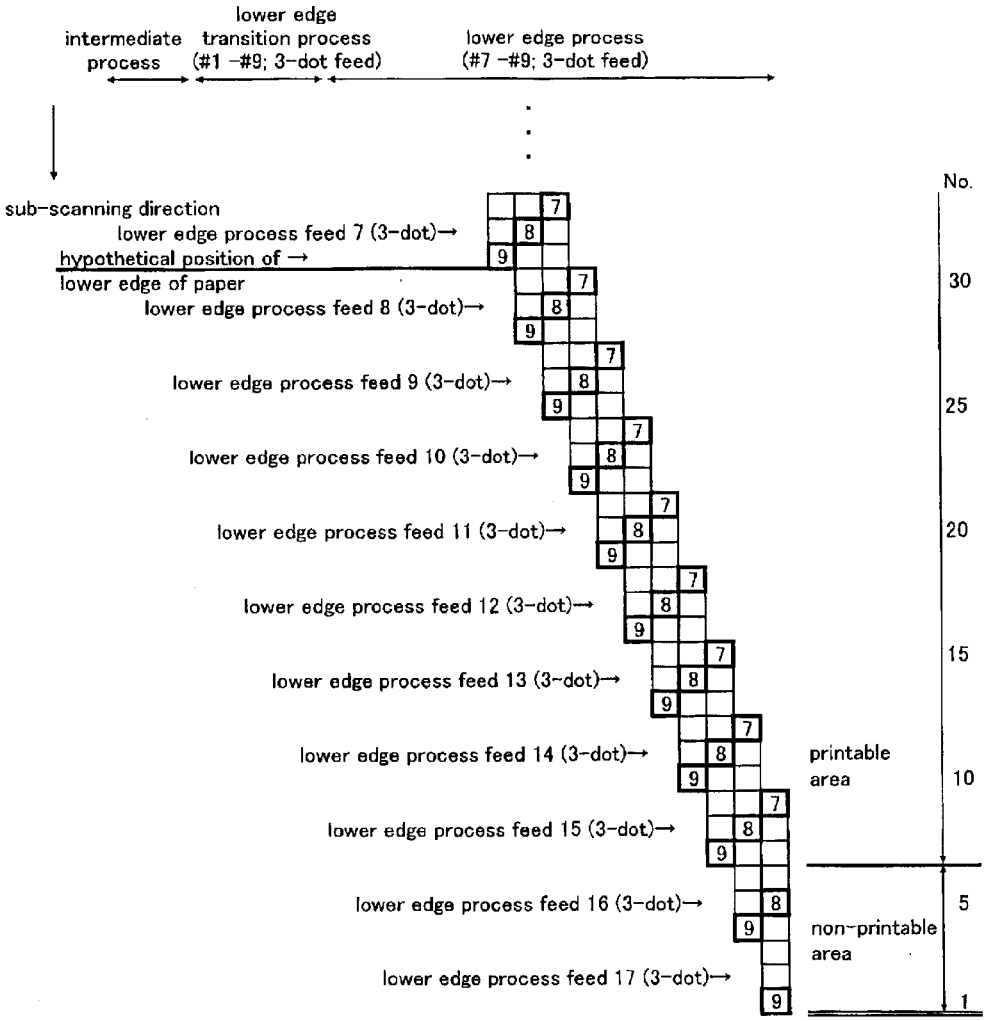
FIG. 12 is a schematic diagram showing how main scan lines are recorded by which nozzles in the lower edge process.

FIGS. 10 to 12 are schematic diagrams showing which nozzles record main scan lines in what manner. In Working Example 1, as shown in FIG. 10, all of the nozzles are used in the intermediate process, and after repeated constant 11-dot feed, in the subsequent lower edge transition process, dots are formed by performing five iterations of advance by 3 dots, using nozzles #1–#9 (nozzle groups Ni, Nh). That is, in the lower edge transition process, the first nozzle group Nf (nozzles #10, #11) are not used. This 3-dot sub-scan feed corresponds to the "lower edge transition portion sub-scan mode" recited in the claims. The area of printing paper P recorded during five iterations of sub-scan advance by 3 dots (see FIGS. 10, 11) corresponds to the "lower edge transition portion" recited in the claims.

As shown in FIGS. 11 and 12, after completing the lower edge transition process, in the lower edge process, dots are formed by performing 17 iterations of advance by 3 dots, using only nozzles #7–#9 (second nozzle group Nh). This constant 3-dot feed corresponds to the "lower edge portion sub-scan mode" recited in the claims. The area of printing paper P recorded during 17 iterations of 3-dot advance (see FIGS. 11, 12) corresponds to the "lower edge portion" recited in the claims. The "upper edge portion", "upper edge transition portion", "intermediate portion", "lower edge transition portion" and "lower edge portion" of printing paper P may overlap in some instances, but these are linked up in order from the top on the surface of printing paper P. Division of the printing paper into "upper edge portion", "upper edge transition portion", "intermediate portion", "lower edge transition portion" and "lower edge portion" herein includes aspects such as that described above.

When feed is performed in this manner, each of main scan lines in the main scanning direction, with the exception of some, is recorded by a single nozzle. In FIGS. 10 to 12, main scan lines on which dots are recordable by nozzles on the print head 28 are numbered in order from the bottom, these being shown to the right in the drawings. This convention is used in subsequent drawings describing recording of dots in the lower edge process.

In FIG. 12, the 2nd, 3rd and 6th main scan lines from the lowermost level are not passed across by nozzles in main scanning during printing. Accordingly, the printable area in the lower edge portion of the printing paper is the area of the 7th main scan line from the lowermost level and the lines thereabove.

In FIG. 10, the 80th and 81st main scan lines from the bottom are passed across twice by nozzles in main scanning during printing. The same is true of the 59th and 63rd main scan lines from the bottom in FIG. 11. In the process transitioning from the intermediate process to the lower edge process, main scan lines passed across two or more times by the nozzles are recorded dots during only one of these times. Here, dots are recorded by the nozzles as the nozzles initially pass across the main scan line. In preferred practice these main scan lines will be recorded by nozzles passing over the main scan lines in the intermediate process or lower edge transition process. The intermediate process and lower edge transition process employ more nozzles than the lower edge process. Thus, the characteristics of a small number of nozzles will not be reflected in the printed result, thereby giving a printed result of high quality.

As a result of printing in the manner described above, the area extending to the 58th main scan line (counting from the lowermost main scan line on which the print head can record dots), is recorded by nozzles #7, #8 and #9 only (i.e. the second nozzle group Nh), as shown in FIGS. 11 and 12. The 59th and subsequent main scan lines are recorded using nozzles #1–#11 (nozzle groups Ni, Nh, Nf). The relationship of main scan lines and printing paper P and the effects thereof are described hereinbelow.

In first image printing mode, an image is recorded to the bottom edge without any blank space, in a manner similar to the upper edge. As noted, in Working Example 1, of the main scan lines on which dots can be recorded by the nozzles of the print head 28, an image can be recorded using the 7th and subsequent main scan lines (printable area) from the downstream edge in the sub-scanning direction. However, in consideration of possible error in feed distance during sub-scan feed, recording onto the printing paper is begun at the 31st main scan line from the downstream edge in the sub-scanning direction. That is, with the lower edge of the printing paper P positioned at the 31st main scan line from the downstream edge in the sub-scanning direction, ink drops Ip are ejected onto the 30th and preceding main scan lines as well, to perform a final main scan during printing. Thus, at termination of printing the hypothetical position of the lower edge of the printing paper with respect to the main scan lines is located at the 31st main scan line from the downstream edge in the sub-scanning direction, as shown in FIG. 11.

Figure 13:
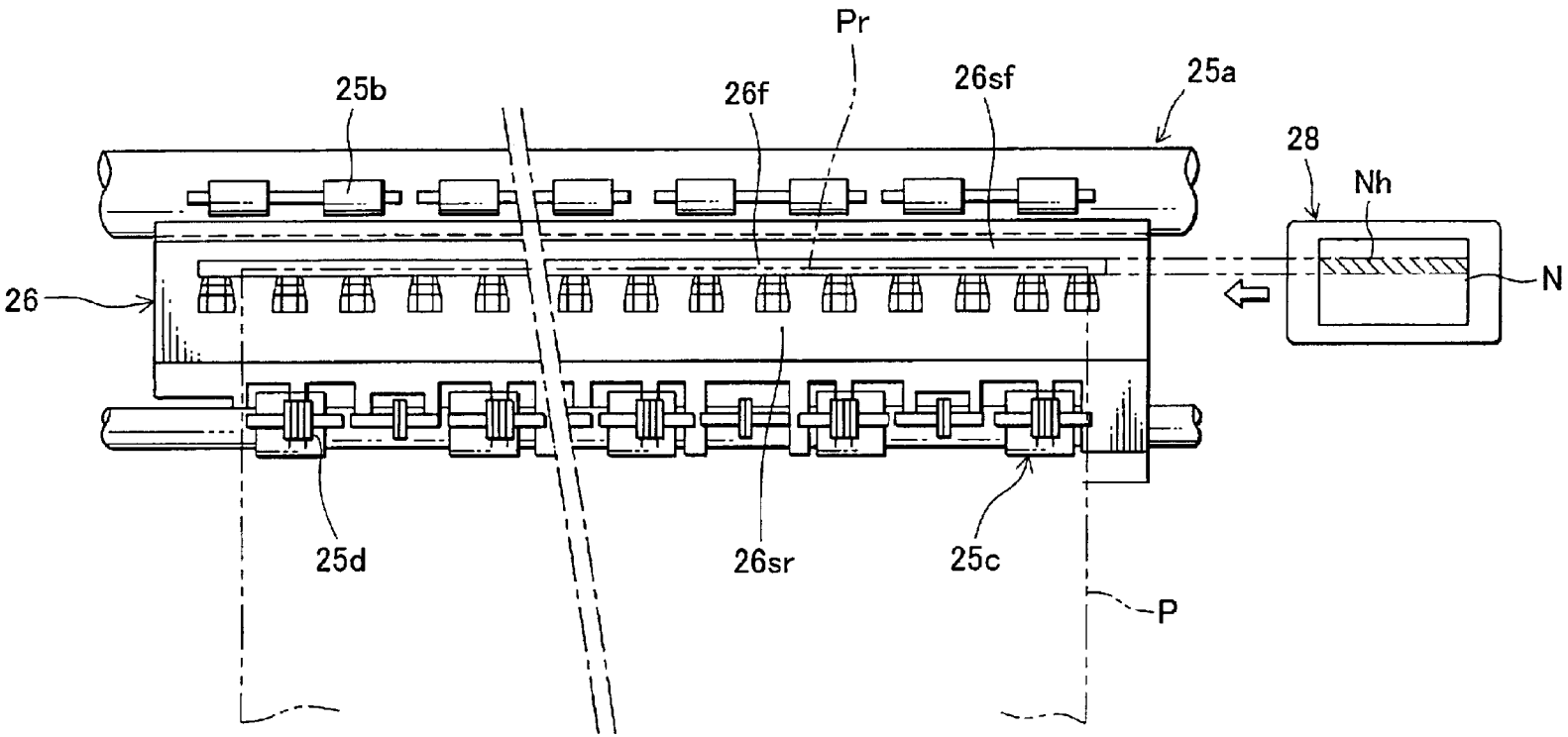
FIG. 13 is a plan view showing the relationship of recessed portion 26*f* and printing paper P during printing of the lower edge portion Pr of printing paper P.

FIG. 13 is a plan view showing the relationship of recessed portion 26*f* and printing paper P during printing of the lower edge portion Pr of printing paper P. In FIG. 13, the second nozzle group Nh (shown as the portion hatched by diagonal lines) consists of nozzles #7, #8 and #9. During main scanning, recessed portion 26*f* is located below the portion passed across by these nozzles. When the lower edge Pr of the printing paper P is positioned at the location over recessed portion 26*f* indicated by the dot-and-dashed line, actual recording of dots onto printing paper P terminates.

Figure 14:
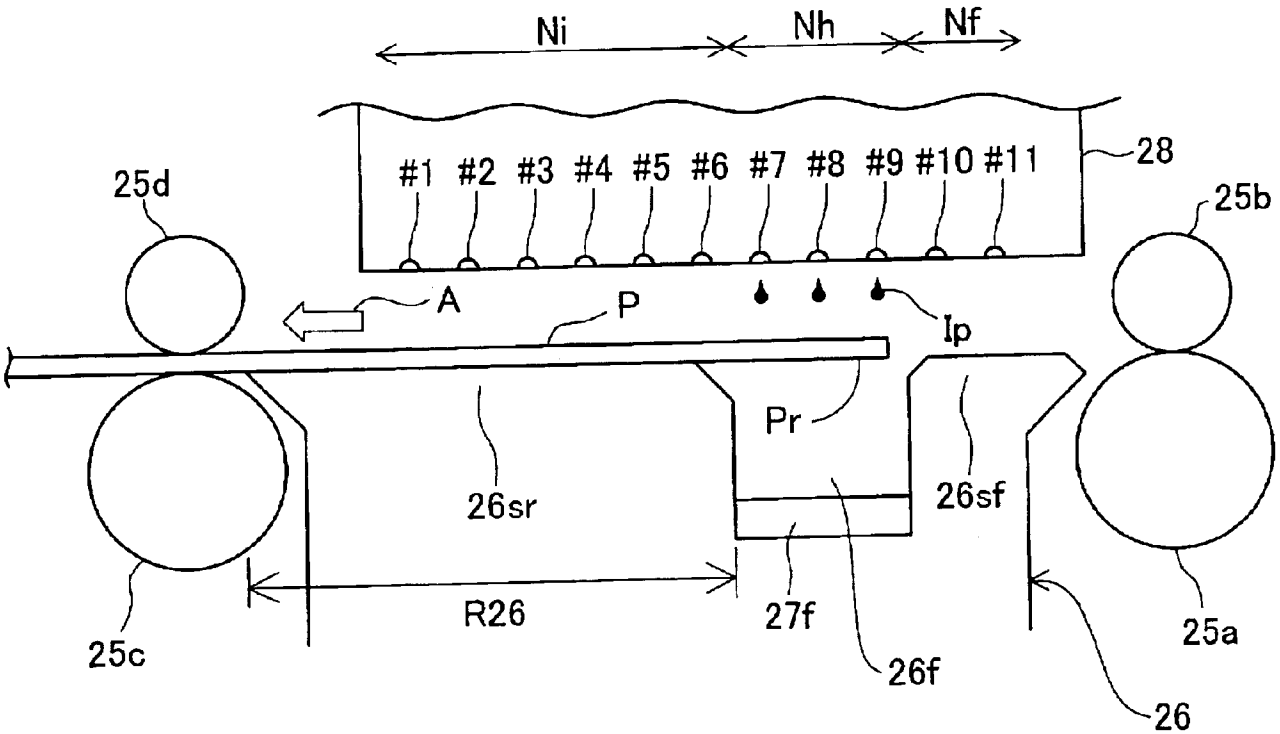
FIG. 14 is a side view showing the relationship of print head 28 and printing paper P during printing of the lower edge portion Pr of printing paper P.

FIG. 14 is a side view showing the relationship of print head 28 and printing paper P during printing of the lower edge portion Pr of printing paper P. As noted, when printing the lower edge portion Pr of printing paper P, the lower edge Pr of printing paper P is positioned at the 31st main scan line from the downstream edge in the sub-scanning direction of the main scan lines on which dots can be recorded by the nozzles of the print head 28 (see FIG. 12). That is, when main scan lines at the lower edge of printing paper P are recorded, the lower edge of printing paper P is directly below nozzle #9. Thus, with subsequent sub-scanning and ejection of ink drops from nozzles #7–#9, the ejected inks drops Ip fall into the recessed portion 26*f*.

However, where for some reason printing paper P advances by a lesser distance than the regular feed distance, nozzles #7, #8 and #9 nevertheless eject ink drops Ip onto main scan lines set beyond the lower edge of printing paper P (in FIG. 12, the 7th to 30th main scan lines from the bottom) so that an image can be recorded on the lower edge Pr of printing paper P with no blank spaces. In other words, where the feed distance deficit does not exceed 24 lines, no blank spaces will be produced at the lower edge of printing paper P.

The 28 lines above a hypothetic lower edge position on the paper (in FIG. 11, the 31st to 62nd main scan lines from the bottom) are recorded by nozzles #7, #8 and #9. Thus, where for some reason printing paper P advances by a greater distance than the regular feed distance, the ejected ink drops will fall into recessed portion 26*f* and will not be deposited on the upper face of platen 26.

The advantage described hereinabove is achieved, in printing of the lower edge of printing paper P, by ejecting ink drops from at least a portion of the second nozzle group Nh (second dot-forming element sub-group) to form dots on the printing paper P, while the lower edge of the printing paper P is positioned over the opening of the recessed portion 26*f*.

In Working Example 1, printing is performed using all nozzles during the intermediate process. Thus, printing can be performed rapidly in the intermediate process.

Further, in Working Example 1, only nozzle groups Nh and Ni (nozzles #1–#9) are used in the lower edge transition process which follows the intermediate process and precedes the lower edge process. That is, the process does not use the first nozzle group Nf (nozzles #10, #11) situated upstream from the second nozzle group Nh used in lower edge processing.

The sub-scan feed is the same as in the lower edge process. This enables smooth transition from the intermediate process to the lower edge process without back-feed in sub-scanning. Printed result quality is therefore higher.

As noted earlier, the CPU 41 (see FIG. 3) performs the lower edge transition process using nozzle groups Nh, Ni (nozzles #1–#9) and the lower edge process using the second nozzle group (nozzles #7, #8, #9). That is, CPU 41 functions as the "lower edge transition printing unit" and "lower edge printing unit" recited in the claims. These functional portions of CPU 41 are shown in FIG. 3 as lower edge transition printing unit 41*s* and lower edge printing unit 41*t*.

C. Working Example 2

Figure 15:
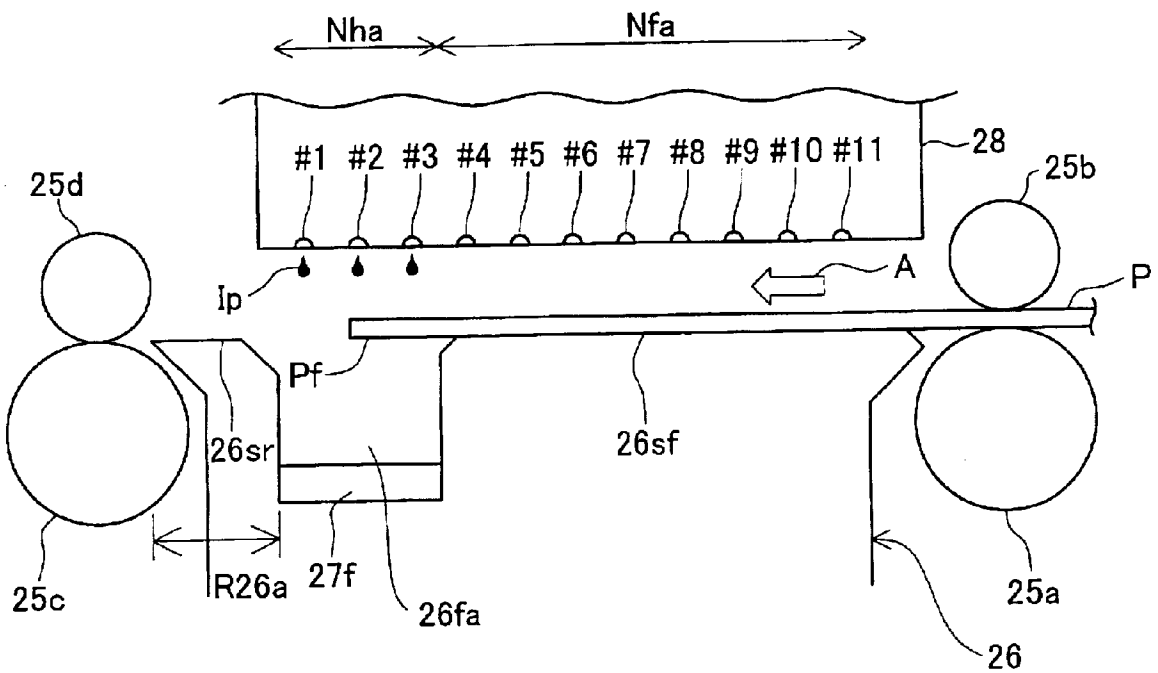
FIG. 15 is a side view showing the relationship of print head 28 and recessed portion 26*fa* in Working Example 2.

FIG. 15 is a side view showing the relationship of print head 28 and recessed portion 26*fa* in Working Example 2. In Working Example 2, there is described a printing device and printing method wherein the recessed portion is at a location facing a nozzle group that includes nozzles at the downstream end. In Working Example 2, the recessed portion 26*ha* provided to platen 26 is provided at a location facing a nozzle group Nha composed of nozzles #1–#3 including nozzle #1 at the downstream end. Nozzles #3–#11 are designated as nozzle group Nfa. The hardware arrangement of the printer of Working Example 2 is otherwise similar to that of the printer of Working Example 1.

Figure 16:
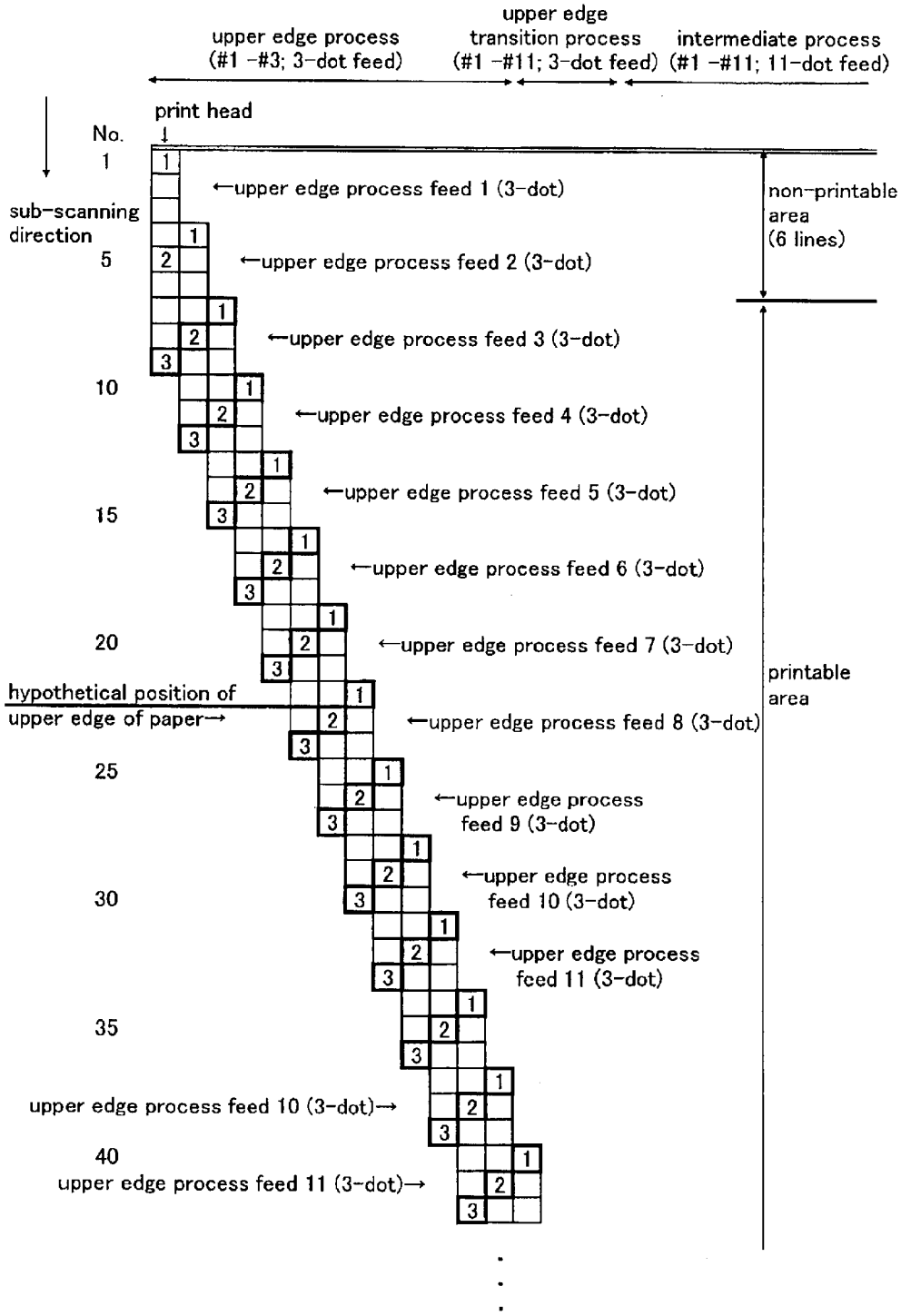
FIG. 16 is a schematic diagram showing how main scan lines are recorded by which nozzles in the upper edge process of Working Example 2.
Figure 17:
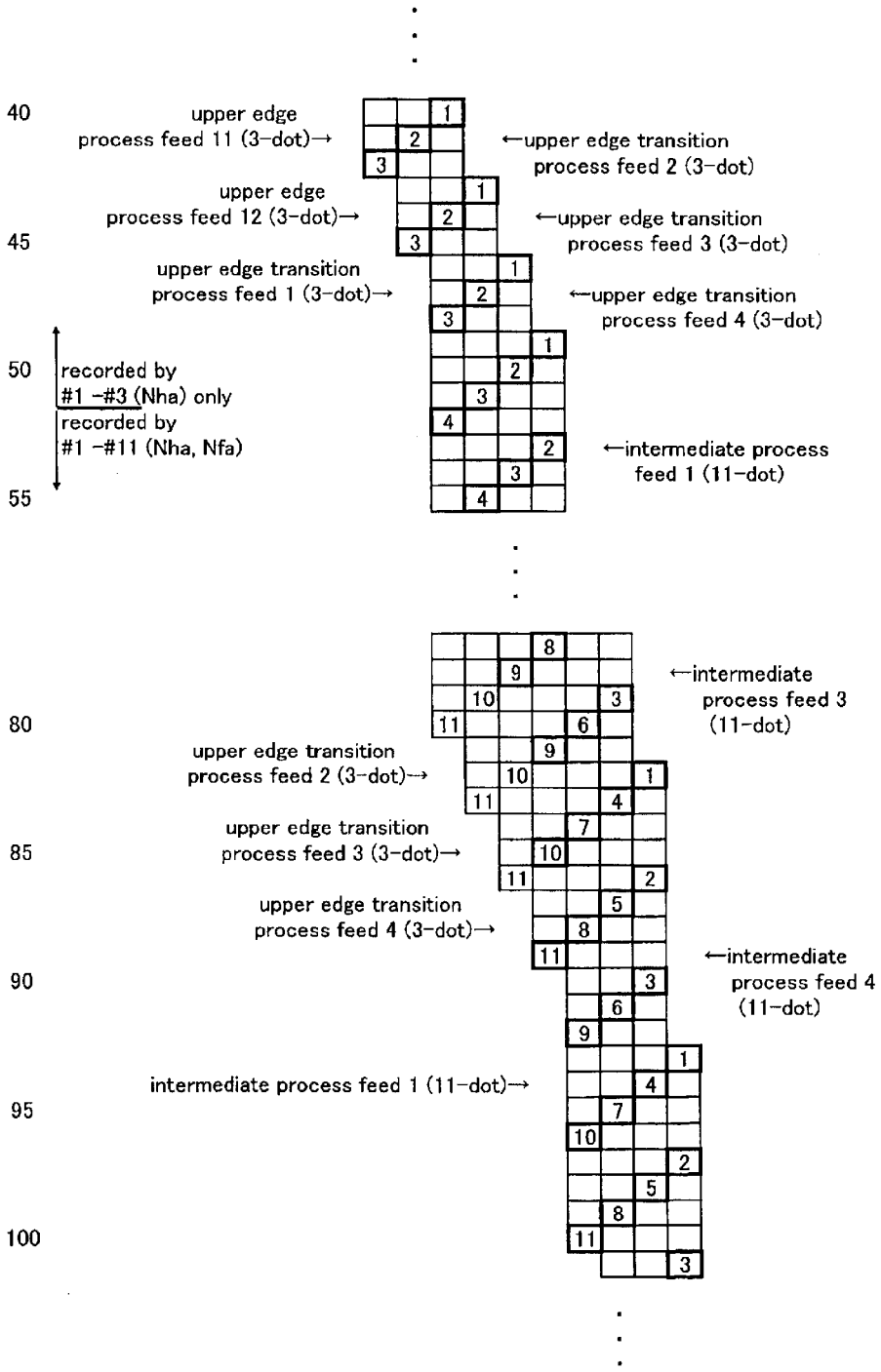
FIG. 17 is a schematic diagram showing how main scan lines are recorded by which nozzles in the upper edge process, upper edge transition process and intermediate process of Working Example 2.

(1) Upper Edge Process, Upper Edge Transition Process and Intermediate Process FIGS. 16 and 17 are schematic diagrams showing how main scan lines are recorded by which nozzles in the upper edge process, upper edge transition process and intermediate process of Working Example 2. As shown in FIGS. 16 and 17, in the upper edge process of Working Example 2, nozzle group Nha (nozzles #1–#3) is used, performing twelve iterations of advance by 3 dots. Nozzles surrounded by thick borders are the nozzles used to record dots on main scan lines.

After the upper edge process, the upper edge transition process is performed, still at 3-dot feed, using all of nozzles #1–#11 (nozzle groups Nha, Nfa). In the upper edge transition process, sub-scan feed is performed a total of four times.

After the upper edge transition process, the system moves to the intermediate process shown in FIG. 17, performing repeated iterations of advance by 11 dots using all of nozzles #1–#11 (nozzle groups Nha, Nfa). In "intermediate portion sub-scan mode" in the intermediate process, the maximum feed distance may be some other value, provided that it is larger than the maximum sub-scan feed distance in the upper edge process and upper edge transition process.

As shown in FIG. 16, in Working Example 2, an image can be recorded using the 7th and subsequent main scan lines from the upstream edge in the sub-scanning direction (printable area) in the main scan lines recordable with dots by the nozzles of print head 28. Therefore, image data D used for printing is set to the 7th and subsequent main scan lines from the upstream edge in the sub-scanning direction. However, for reasons similar to Working Example 1, printing commences not when the upper edge of printing paper P is positioned at the 7th main scan line from the upstream edge in the sub-scanning direction, but rather when at the location of the 23rd line. That is, in Working Example 2 as well, image data D is set beyond a hypothetical location at the upper edge of printing paper P. The 16 main scan lines to the upstream side of the hypothetical location at the upper edge of printing paper P and the 30 main scan lines to the downstream side thereof are main scan lines recorded with nozzles #1–#3 only.

In Working Example 2, all nozzles are used for printing during the intermediate printing process. Thus, printing can be performed faster than is the case when some nozzles are not used. In Working Example 2, between the upper edge process and the intermediate process there is performed a lower edge transition process employing all of the nozzles as in the intermediate process, but with a smaller maximum feed distance than in the intermediate process. Thus, there is no need for reverse feed when transitioning from the upper edge process to the intermediate process, and printing can be performed smoothly. Quality of the printed result is therefore higher.

(2) Lower Edge Transition Process and Lower Edge Process

Figure 18:
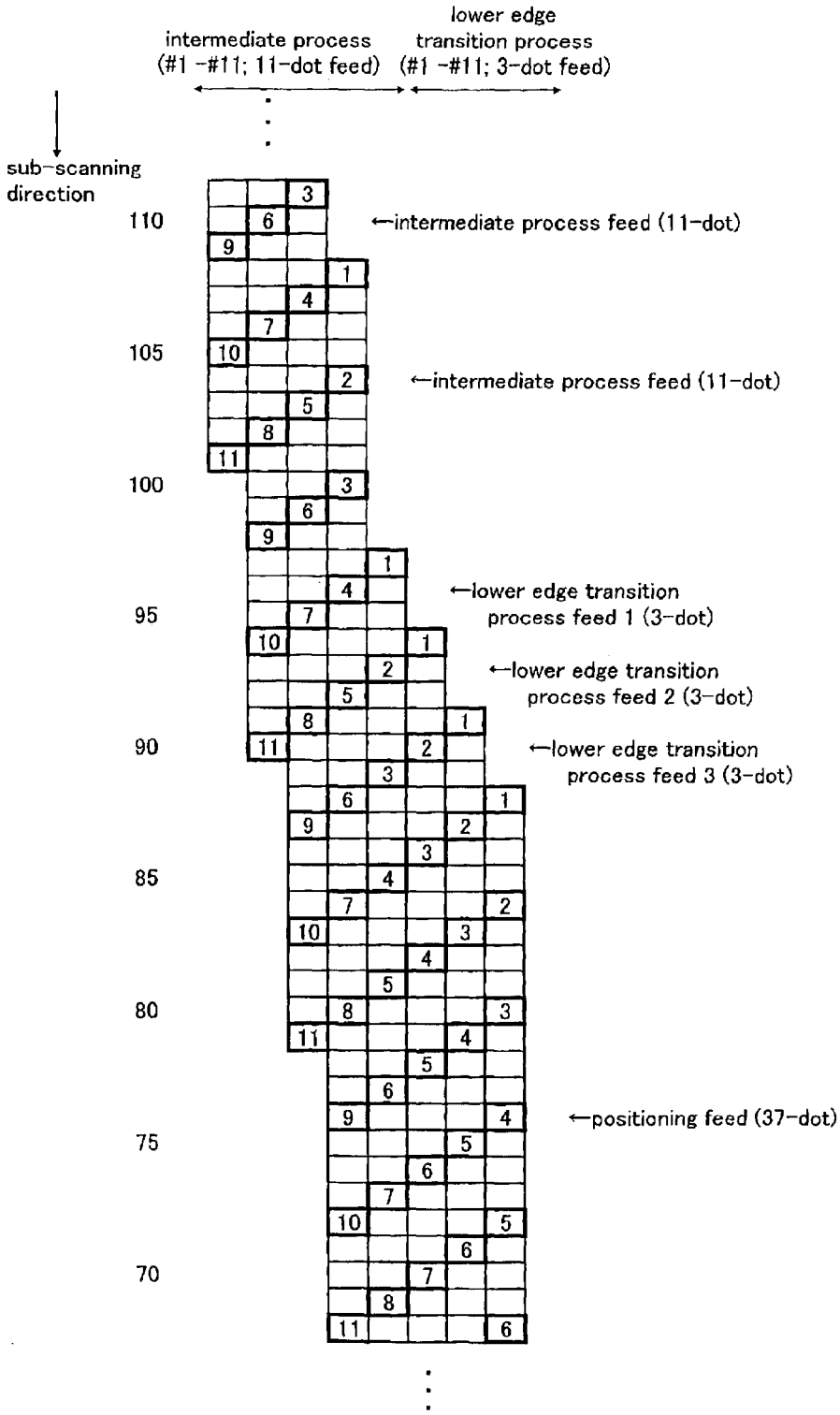
FIG. 18 is a schematic diagram showing how main scan lines are recorded by which nozzles in the intermediate process and lower edge transition process in Working Example 2.
Figure 19:
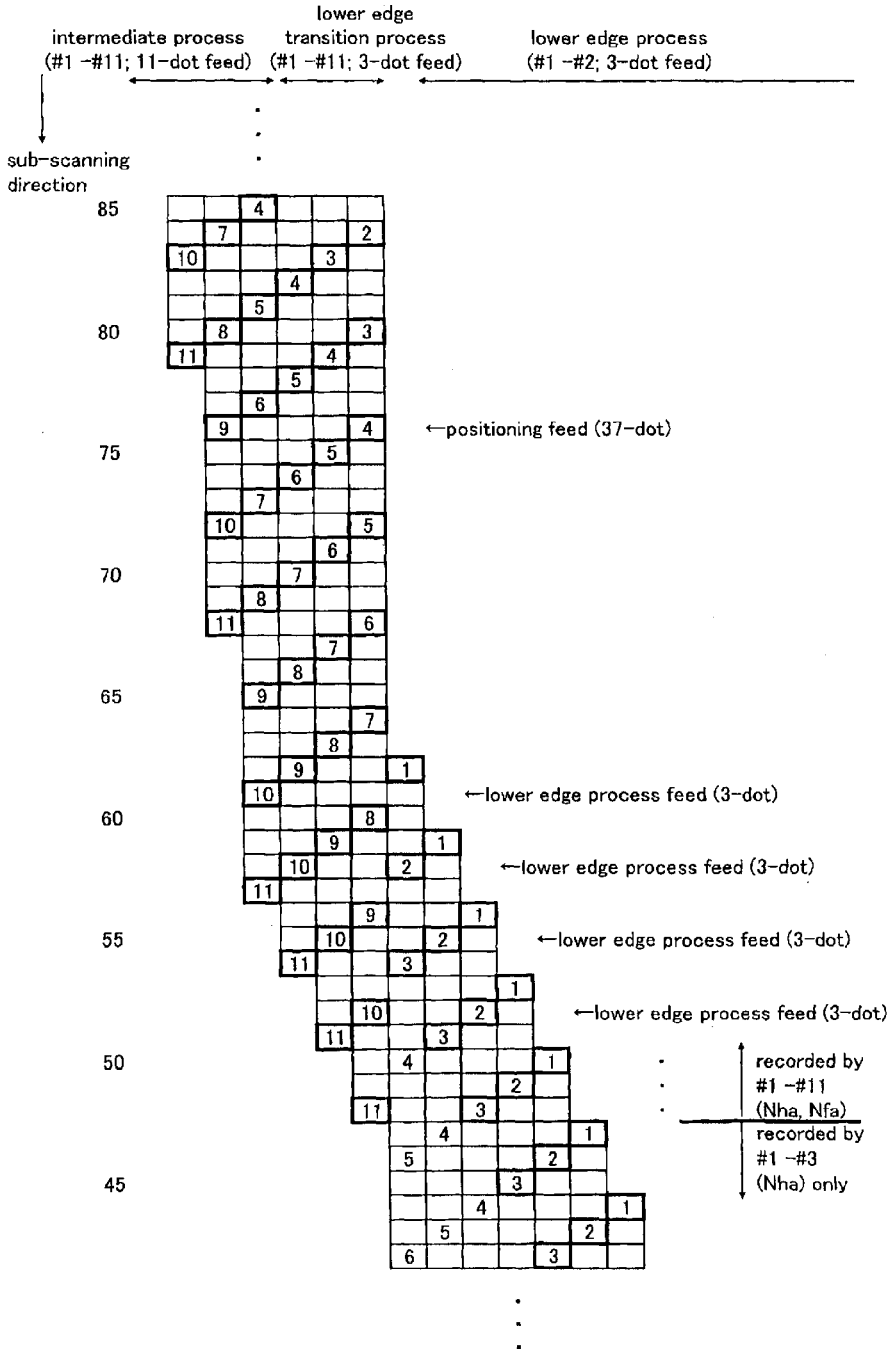
FIG. 19 is a schematic diagram showing how main scan lines are recorded by which nozzles in the intermediate process and lower edge transition process in Working Example 2.

FIG. 18 is a schematic diagram showing how nozzles record main scan lines during the intermediate process and lower edge transition process in Working Example 2. FIG. 19 is a schematic diagram showing how nozzles record main scan lines during the lower edge transition process and lower edge process in Working Example 2. In Working Example 2, as shown in FIG. 18, after repeated 11-dot feed using all of the nozzles (nozzle groups Nha, Nfa) in the intermediate process, in the subsequent lower edge transition process, 3-dot feed using all of the nozzles (nozzle groups Nha, Nfa) is repeated three times in that order. Subsequently, a positioning feed by a 37-dot feed distance is performed. In the subsequent lower edge process shown in FIG. 19, 3-dot feed using nozzles #1–#3 (nozzle group Nha) only is repeated.

In both the upper edge process and lower edge process of Working Example 2, if more nozzles than the number needed to record all pixels of a given main scan line pass across the main scan line, dots are recorded only during the number of main scans needed to record all pixels of the main scan line. As a result, in some instances there may be present among nozzles #1 #3 nozzles that are not used on a given main scan line during the upper edge process or lower edge process.

While not shown in the drawing, in Working Example 2, of the main scan lines on which dots can be recorded by the nozzles of the print head 28, an image can be recorded using the 6th and subsequent main scan lines (printable area) from the downstream edge in the sub-scanning direction. Image data D used for printing is set to the 7th and subsequent main scan lines from the upstream edge in the sub-scanning direction. However, for reasons similar to Working Example 1, image data is set such that recording of dots on printing paper P terminates not when the lower edge of printing paper P is positioned at the 7th main scan line from the downstream edge in the sub-scanning direction, but rather when at the location of the 27th line. That is, in Working Example 2 as well, image data D is set beyond a hypothetical location at the lower edge of printing paper P. The 20 main scan lines to the downstream side of the hypothetical location at the lower edge of printing paper P and the 21 main scan lines to the upstream side thereof are main scan lines recorded with nozzles #1–#3 only.

In Working Example 2 described hereinabove, a lower edge transition process wherein maximum feed distance is smaller than in the intermediate process (3-dot feed) is performed between the intermediate process and the lower edge process. Thus, there is no need for reverse feed when transitioning from the intermediate process to the lower edge process, and printing can be performed smoothly. Quality of the printed result is therefore higher.

D. Working Example 3

Figure 20:
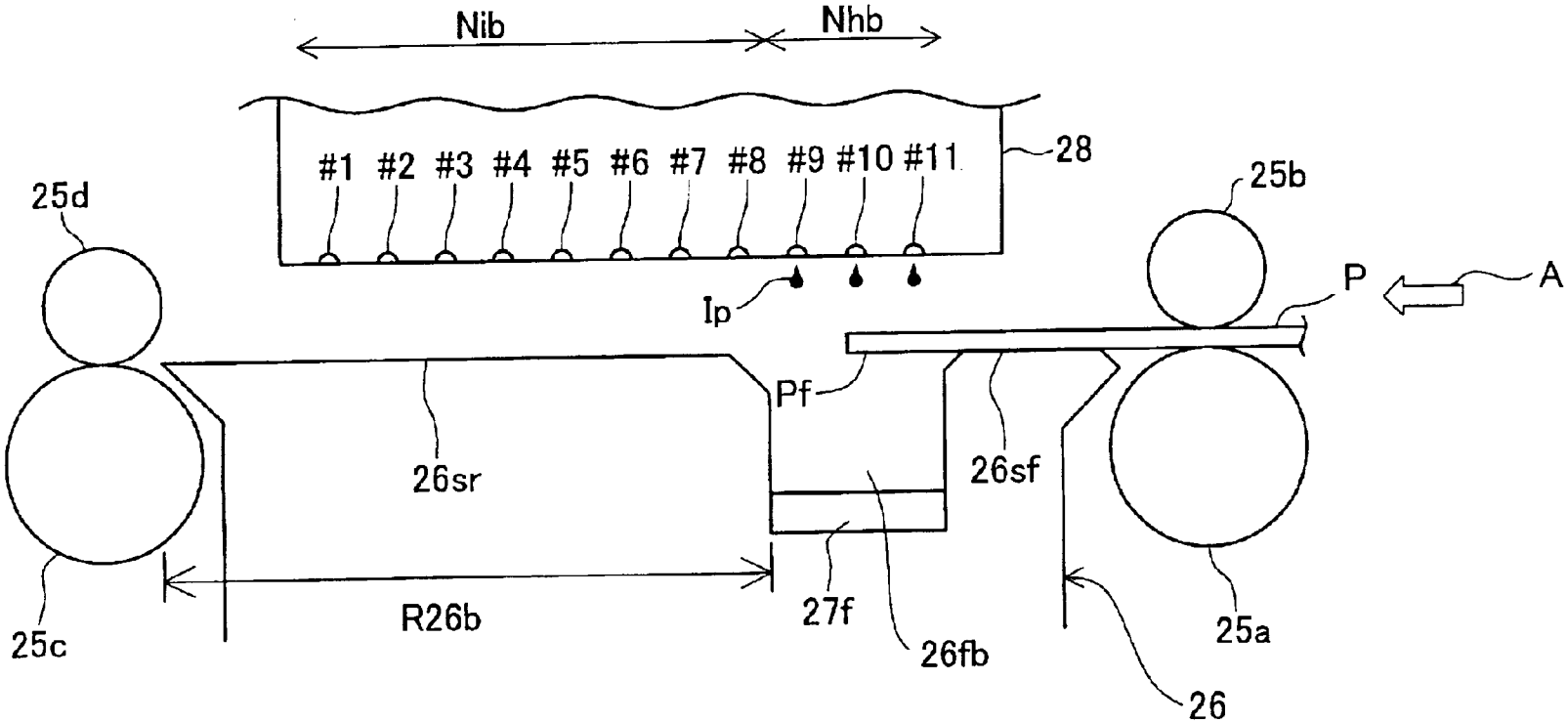
FIG. 20 is a side view showing the relationship of print head 28 and recessed portion 26*fb* in Working Example 3.

FIG. 20 is a side view showing the relationship of print head 28 and recessed portion 26*fb* in Working Example 3. In Working Example 3, there is described a printing device and printing method wherein the recessed portion is at a location facing a nozzle group that includes nozzles at the upstream end. In Working Example 3, the recessed portion 26*fb* provided to platen 26 is provided at a location facing a nozzle group Nhb composed of nozzles #9–#11 including nozzle #11 at the downstream end. Nozzles #1–#8 are designated as nozzle group Nib. The hardware arrangement of the printer of Working Example 3 is otherwise similar to that of the printer of Working Example 1.

(1) Upper Edge Process, Upper Edge Transition Process and Intermediate Process

Figure 21:
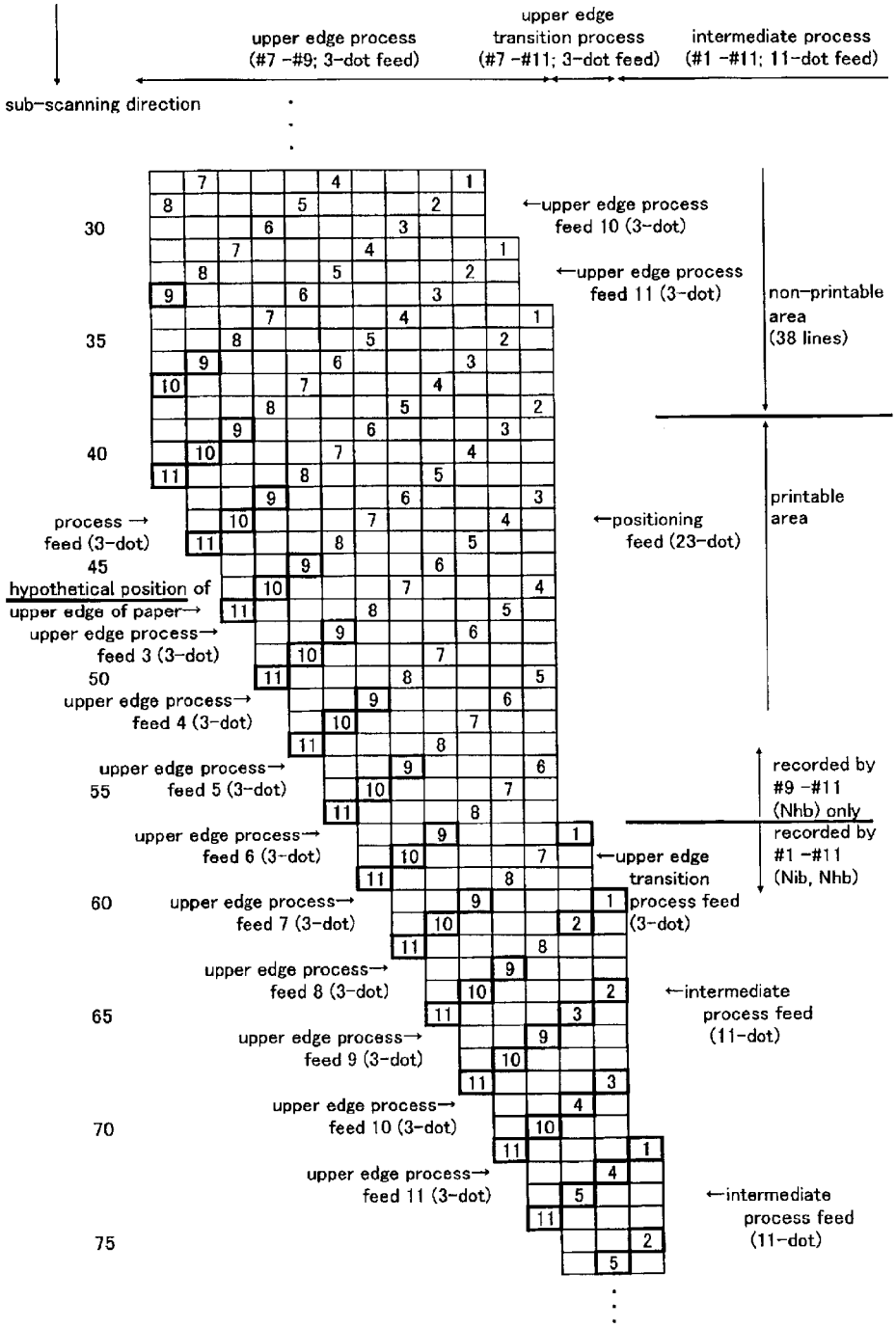
FIG. 21 is a schematic diagram showing how main scan lines are recorded by which nozzles in the upper edge process, upper edge transition process and intermediate process upper edge of Working Example 3.

FIG. 21 is a schematic diagram showing how main scan lines are recorded by which nozzles in the upper edge process, upper edge transition process and intermediate process upper edge of Working Example 3. As shown in FIG. 21, in the upper edge process of Working Example 3, nozzle group Nhb (nozzles #9–#11) is used, performing eleven iterations of advance by 3 dots. Nozzles surrounded by thick borders are the nozzles used to record dots on main scan lines.

After the upper edge process, when entering the upper edge transition process, a positioning feed by a 23-dot feed distance is performed, and then one main scan is performed using all of nozzles #1–#11 (nozzle groups Nhb, Nib). The system then moves to the upper edge transition process, wherein 3-dot feed is performed and main scanning is performed using all of nozzles #1–#11 (nozzle groups Nhb, Nib). In the upper edge transition process, sub-scan feed is performed only one time.

After the upper edge transition process, the system moves to the intermediate process shown in FIG. 21, performing repeated iterations of advance by 11 dots using all of nozzles #1–#11 (nozzle groups Nhb, Nib). In "intermediate portion sub-scan mode" in the intermediate process, the maximum feed distance may be some other value, provided that it is larger than the maximum sub-scan feed distance in the upper edge process and upper edge transition process.

As shown in FIG. 21, in Working Example 3, of the main scan lines recordable with dots by the nozzles of print head 28, an image can be recorded using the 39th and subsequent main scan lines from the upstream edge in the sub-scanning direction (printable area). However, printing commences not when the upper edge of printing paper P is positioned at the 39th main scan line from the upstream edge in the sub-scanning direction, but rather when at the location of the 46th line. That is, in Working Example 3 as well, image data D is set beyond a hypothetical location at the upper edge of printing paper P. The 8 main scan lines to the upstream side of the hypothetical location at the upper edge of printing paper P and the 10 main scan lines to the downstream side thereof are main scan lines recorded with nozzles #9–#11 only.

In Working Example 3, all nozzles are used for printing during the intermediate printing process. Thus, printing can be performed faster than is the case when some nozzles are not used. In Working Example 3, between the upper edge process and the intermediate process there is performed a lower edge transition process employing all of the nozzles as in the intermediate process, but with a smaller maximum feed distance (3 dots) than in the intermediate process. Thus, there is no need for reverse feed when transitioning from the upper edge process to the intermediate process, and printing can be performed smoothly. Quality of the printed result is therefore higher.

(2) Lower Edge Transition Process and Lower Edge Process

Figure 22:
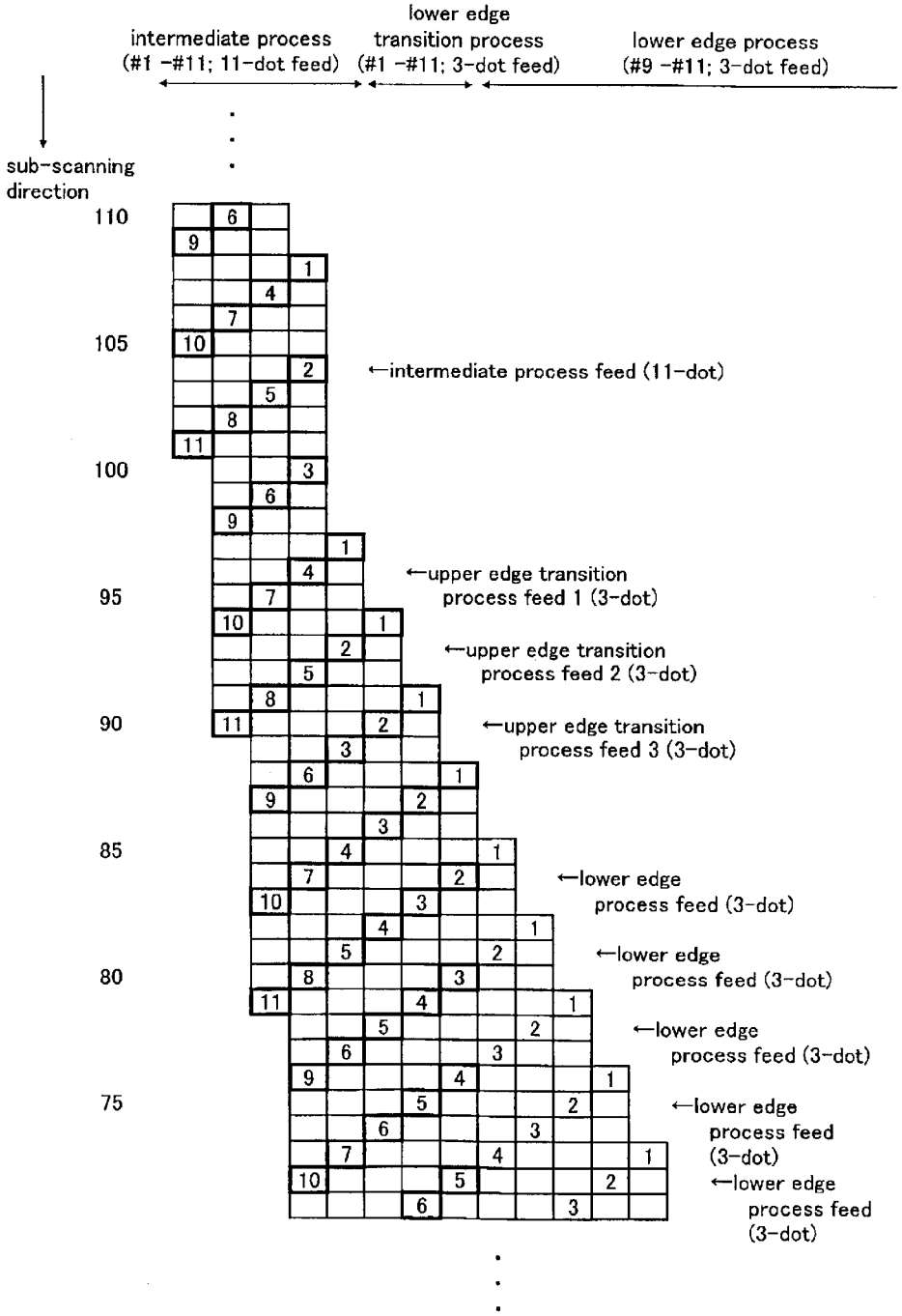
FIG. 22 is a schematic diagram showing how main scan lines are recorded by which nozzles in the intermediate process, lower edge transition process and lower edge process in Working Example 3.
Figure 23:
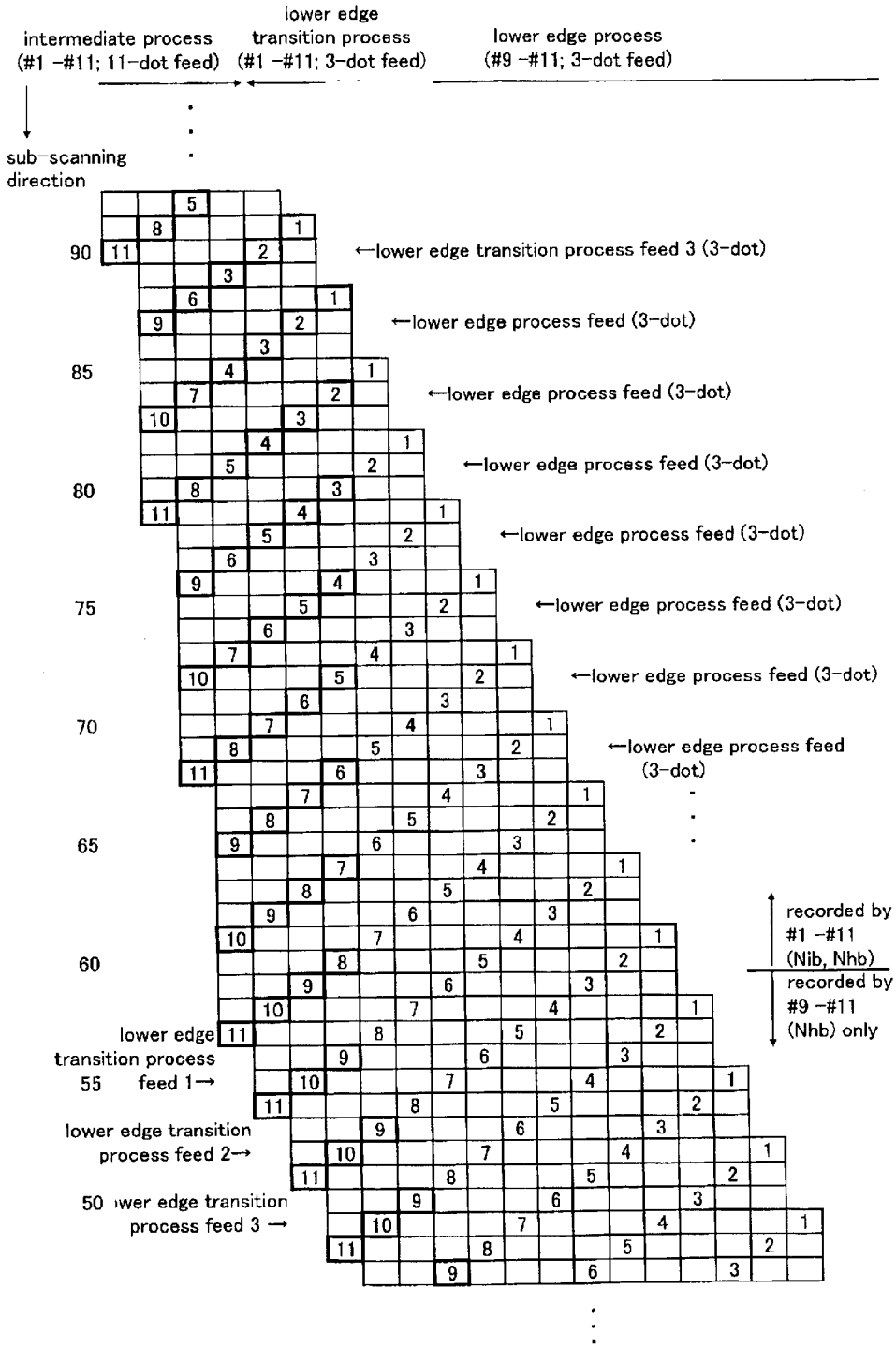
FIG. 23 is a schematic diagram showing how main scan lines are recorded by which nozzles in the intermediate process, lower edge transition process and lower edge process in Working Example 3.
Figure 24:
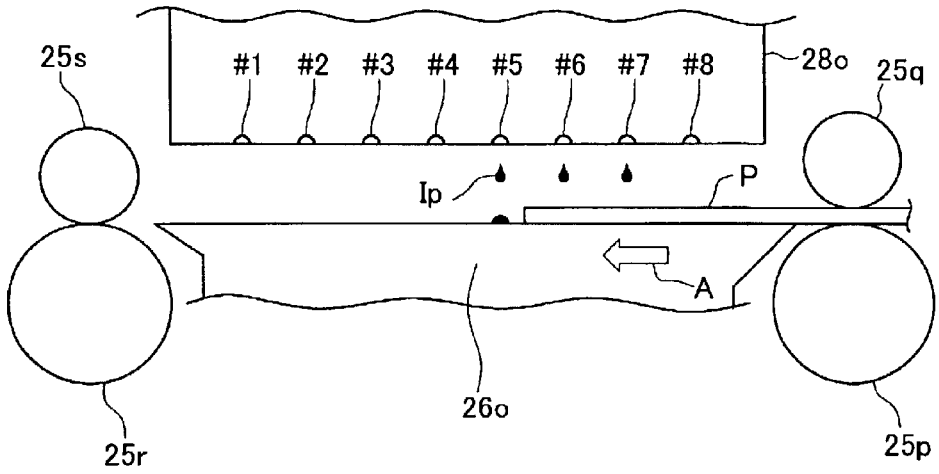
FIG. 24 is a side view depicting the print head and surrounding area in a conventional printer.

FIGS. 22 and 23 are schematic diagrams showing how nozzles record main scan lines during the intermediate process, lower edge transition process and lower edge process in Working Example 3. In Working Example 3, as shown in FIG. 22, after repeated 11-dot feed using all of the nozzles in the intermediate process, in the subsequent lower edge transition process, 3-dot feed using all of the nozzles (nozzle groups Nib, Nhb) is repeated three times in that order. In the subsequent lower edge process shown in FIG. 23, 3-dot feed using nozzles #1–#3 (nozzle group Nhb) only is repeated.

In both the upper edge process and lower edge process of Working Example 3, if more nozzles than the number needed to record all pixels of a given main scan line pass across the main scan line, dots are recorded only during the number of main scans needed to record all pixels of the main scan line, in which respect it is similar to Examples 1 and 2.

While not shown in the drawing, in Working Example 3, of the main scan lines on which dots can be recorded by the nozzles of the print head 28, an image can be recorded using the 6th and subsequent main scan lines (printable area) from the downstream edge in the sub-scanning direction. Image data D used for printing is set to the 7th and subsequent main scan lines from the upstream edge in the sub-scanning direction. However, image data is set such that recording of dots on printing paper P terminates not when the lower edge of printing paper P is positioned at the 7th main scan line from the downstream edge in the sub-scanning direction, but rather when at the location of the 27th line. That is, in Working Example 3 as well, image data D is set beyond a hypothetical location at the lower edge of printing paper P. The 20 main scan lines to the downstream side of the hypothetical location at the lower edge of printing paper P and the 33 main scan lines to the upstream side thereof are main scan lines recorded with nozzles #9–#11 only.

In Working Example 3 described hereinabove, a lower edge transition process wherein maximum feed distance is smaller than in the intermediate process is performed between the intermediate process and the lower edge process. Thus, there is no need for reverse feed when transitioning from the intermediate process to the lower edge process, and printing can be performed smoothly. Quality of the printed result is therefore higher.

E. Variations

The invention is not limited to the examples and embodiments described hereinabove, and may be reduced to practice in various ways without departing from the scope and spirit thereof. For example, the following variations are possible.

E1. Variation 1

In the preceding examples, upper edge portion sub-scan mode, upper edge transition portion sub-scan mode, lower edge transition portion sub-scan mode and lower edge portion sub-scan mode all proceed under constant 3-dot feed. However, feed in each mode is not limited to this. For example, depending on the number of nozzles and nozzle pitch in the nozzle rows, constant feed by 5 dots or by 7 dots could be used instead. Alternatively, feed may be varied in each mode, for example, 2-dot, 3-dot, 2-dot, 2-dot, 1-dot, 2-dot non-constant feed in upper edge portion sub-scan mode, 2-dot, 1-dot, 2-dot, 3-dot, 2-dot, 2-dot non-constant feed in upper edge transition portion sub-scan mode, and so on. Some combination of constant feed and non-constant feed may be used among the upper edge portion sub-scan mode, upper edge transition portion sub-scan mode, lower edge transition portion sub-scan mode and lower edge portion sub-scan mode. "Non-constant feed" refers to a method of performing sub-scans by some combination of different feed distances. That is, it is sufficient for feed in upper edge portion sub-scan mode, upper edge transition portion sub-scan mode, lower edge transition portion sub-scan mode and lower edge portion sub-scan mode to be such that the maximum sub-scan feed distance is smaller than the maximum sub-scan feed distance in the intermediate process. With smaller sub-scan feed distances the upper edge of the printing paper can be recorded with nozzles situated more towards the downstream end in the sub-scanning direction. This allows the recessed portion to be narrower so that the area of the upper face of the platen supporting the printing paper is larger. With non-constant feed, the quality of the printed result is higher than with constant feed.

In the case of constant feed, sub-scanning by equal feed distances is repeated. Thus, "maximum sub-scan feed distance" will be equivalent to the feed distance in each sub-scan. In the case of non-constant feed, on the other hand, a combination of sub-scans by different feed distances is performed. The maximum sub-scan feed distance among this combination of sub-scans by different feed distances will be the "maximum sub-scan feed distance". Cases where "sub-scan modes are mutually equivalent" would include cases of mutually equivalent feed distances among constant feeds; and among non-constant feeds, cases where the combinations of sub-scans by different feed distances are mutually equivalent. It should be noted that where the number of sub-scans is smaller than the number of combinations of sub-scans by different feed distances, in some instances the combinations of sub-scans by different feed distances may coincide only partially.

In the preceding examples, a single scan line is recorded by a single nozzle, but the printing method is not limited thereto, it being possible to perform overlap printing instead. "Overlap printing" refers to a method wherein printing of pixels in a single main scan line is apportioned to a plurality of nozzles. In overlap printing, a single main scan line has dots recorded thereon by a plurality of nozzles passing across the main scan line. The plurality of nozzles pass across the main scan line during a plurality of main scanning with different positions of the printing paper relative to the print head in the sub-scanning direction. With overlap printing, the quality of the printed result is higher than without overlap printing.

E2. Variation 2

The invention is applicable not only to color printing but to monochrome printing as well. The invention is suited not only to ink-jet printers, but generally to dot recording devices that record on the surface of a print medium using a recording head that has a plurality of dot-forming element arrays. Here, "dot-forming element" refers to a structural element for forming dots, such as an ink nozzle in an ink-jet printer.

E3. Variation 3

In the preceding examples, some of the arrangements realized through hardware may instead by substituted by software, and conversely some of the arrangements realized through software may instead by substituted by hardware. For example, some of the functions of CPU 41 (see FIG. 3) could be performed by the host computer 90.

A computer program for realizing such functions can be provided in a form recorded on a computer-readable recording medium such as a floppy disk or CD-ROM. The host computer 90 reads the computer program and transfers it to an internal memory device or external memory device. Alternatively, the computer program may be provided to the host computer 90 from a program supplying device via a communications link. When realizing the functions of the computer program, the computer program stored in an internal memory device is executed by the microprocessor of the host computer 90. Alternatively, the computer program recorded on the recording medium may be executed directly by the host computer 90.

Host computer 90 herein refers to a general concept including hardware devices and an operating system, and means hardware devices that operate under control of the operating system. The computer program allows the host computer 90 to realize the various functions mentioned above. Some of the above functions may be realized by the operating system rather than an application program.

"Computer-readable recording medium" herein is not limited to portable storage media such as flexible disks and CD-ROMs, and includes also internal memory devices such as RAM and ROM of various kinds, and external memory devices fixed to the computer, such as a hard disk.

Although the present invention has been described and illustrated in detail, it is clearly understood that the same is by way of illustration and example only and is not to be taken by way of limitation, the spirit and scope of the present invention being limited only by the terms of the appended claims.

What we claimed is:

1. A dot recording device for recording dots on a surface of a print medium using a dot recording head equipped with dot-forming element groups comprising a plurality of dot-forming elements for ejecting drops of ink, the device comprising:

a main scan drive unit which drives the dot recording head and/or the print medium to perform main scanning;

a head drive unit which drives at least part of the plurality of dot-forming elements to form dots during the main scan;

a platen arranged extending in a direction of the main scan so as to face the plurality of dot-forming elements in at least part of a path of the main scan, and supporting the print medium so as to face the dot recording head;

a sub-scan drive unit which drives at intervals between the main scans the print medium in a direction intersecting the direction of the main scan to perform sub-scanning; and a control unit for controlling the main scan drive unit, the head drive unit, and the sub-scan drive unit, wherein the plurality of dot-forming elements comprise:

a first dot-forming element sub-group; and a second dot-forming element sub-group being located downstream from the first dot-forming element sub-group in a direction of the sub-scan, and the platen comprises a recessed portion arranged extending in the direction of the main scan at a location facing the second dot-forming element sub-group, wherein the control unit includes an upper edge printing unit, an intermediate printing unit, and an upper edge transition printing unit, when it is assumed that the surface of the print medium is divided, in order from a top, into an upper edge portion that includes an upper edge, an upper edge transition portion, an intermediate portion, a lower edge transition portion, and a lower edge portion that includes a lower edge, the upper edge printing unit performs upper edge printing for forming dots in the upper edge portion in an upper edge portion sub-scan mode using the second dot-forming element sub-group and without using the first dot-forming element sub-group;

the intermediate printing unit performs intermediate printing for forming dots in the intermediate portion in an intermediate portion sub-scan mode using the first and second dot-forming element sub-groups, the intermediate portion sub-scan mode having a sub-scan maximum feed distance that is greater than a sub-scan maximum feed distance in the upper edge portion sub-scan mode; and the upper edge transition printing unit performs upper edge transition printing for forming dots in the upper edge transition portion in an upper edge transition portion sub-scan mode using the first and second dot-forming element sub-groups, the upper edge transition portion sub-scan mode having a sub-scan maximum feed distance that is smaller than the sub-scan maximum feed distance in the intermediate portion sub-scan mode.

2. A dot recording device according to claim 1, wherein the platen further comprises:

an upstream support portion for supporting the print medium, the upstream support portion extending in the direction of the main scan at a location facing the first dot-forming element sub-group; and a downstream support portion for supporting the print medium, the downstream support portion extending in the direction of the main scan at a location downstream from the recessed portion in the direction of the sub-scan.

3. A dot recording device according to claim 2, wherein the dot recording head comprises a third dot-forming element sub-group in the plurality of dot-forming elements, the third dot-forming element sub-group being located downstream from the second dot-forming element sub-group in the direction of the sub-scan and facing the downstream support portion, the upper edge printing unit performs the upper edge printing without using the third dot-forming element sub-group, the upper edge transition printing unit performs the upper edge transition printing without using the third dot-forming element sub-group, and the intermediate printing unit performs the intermediate printing further using the third dot-forming element sub-group.

4. A dot recording device according to claim 1, wherein the upper edge transition portion sub-scan mode is equivalent to the upper edge portion sub-scan mode.

5. A dot recording device according to claim 1, wherein the upper edge printing unit performs the upper edge printing when the print medium is supported by the platen with the upper edge of the print medium located over an opening of the recessed portion.

6. A dot recording device for recording dots on a surface of a print medium using a dot recording head equipped with dot-forming element groups comprising a plurality of dot-forming elements for ejecting drops of ink, the device comprising:

a main scan drive unit which drives the dot recording head and/or the print medium to perform main scanning;

a head drive unit which drives at least part of the plurality of dot-forming elements to form dots during the main scan;

a platen arranged extending in a direction of the main scan so as to face the plurality of dot-forming elements in at least part of a path of the main scan, and supporting the print medium so as to face the dot recording head;

a sub-scan drive unit which drives at intervals between the main scans the print medium in a direction intersecting the direction of the main scan to perform sub-scanning; and a control unit for controlling the main scan drive unit, the head drive unit, and the sub-scan drive unit, wherein the plurality of dot-forming elements comprise:

a first dot-forming element sub-group; and a second dot-forming element sub-group being located downstream from the first dot-forming element sub-group in a direction of the sub-scan, and the platen comprises a recessed portion arranged extending in the direction of the main scan at a location facing the first dot-forming element sub-group, wherein the control unit includes an intermediate printing unit, a lower edge transition printing unit, and a lower edge printing unit, when it is assumed that the surface of the print medium is divided, in order from a top, into an upper edge portion that includes an upper edge, an upper edge transition portion, an intermediate portion, a lower edge transition portion, and a lower edge portion that includes a lower edge, the intermediate printing unit performs intermediate printing for forming dots in the intermediate portion in an intermediate portion sub-scan mode using the first and second dot-forming element sub-groups;

the lower edge transition printing unit performs lower edge transition printing for forming dots in the lower edge transition portion in a lower edge transition portion sub-scan mode using the first and second dot-forming element sub-groups, the lower edge transition portion sub-scan mode having a sub-scan maximum feed distance that is smaller than a sub-scan maximum feed distance in the intermediate portion sub-scan mode; and the lower edge printing unit performs lower edge printing for forming dots in the lower edge portion in a lower edge portion sub-scan mode using the first dot-forming element sub-group and without using the second dot-forming element sub-group, the lower edge portion sub-scan mode having a sub-scan maximum feed distance that is smaller than the sub-scan maximum feed distance in the intermediate portion sub-scan mode.

7. A dot recording device according to claim 6, wherein the platen further comprises:

a downstream support portion for supporting the print medium, the downstream support portion extending in the direction of the main scan at a location facing the second dot-forming element sub-group; and an upstream support portion for supporting the print medium, the upstream support portion extending in the direction of the main scan at a location upstream from the recessed portion in the direction of the sub-scan.

8. A dot recording device according to claim 7, wherein the dot recording head comprises a third dot-forming element subgroup in the plurality of dot-forming elements, the third dot-forming element sub-group being located upstream from the first dot-forming element sub-group in the direction of the sub-scan and facing the upstream support portion, the intermediate printing unit performs the intermediate printing further using the third dot-forming element sub-group, the lower edge transition printing unit performs the lower edge transition printing without using the third dot-forming element sub-group, and the lower edge printing unit performs the lower edge printing without using the third dot-forming element sub-group.

9. A dot recording device according to claim 6, wherein the lower edge transition portion sub-scan mode is equivalent to the lower edge portion sub-scan mode.

10. A dot recording device according to claim 6, wherein the lower edge printing unit performs the lower edge printing when the print medium is supported by the platen with the lower edge of the print medium located over an opening of the recessed portion.

11. A dot recording method for use in a dot recording device that records dots on a surface of a print medium supported on a platen using a dot recording head equipped with dot-forming element groups comprising a plurality of dot-forming elements for ejecting drops of ink, wherein main scanning is performed by driving the dot recording head and/or the print medium while driving at least part of the plurality of dot-forming elements to form dots, and sub-scanning is performed at intervals between the main scans by driving the print medium in a direction intersecting a direction of the main scan;

wherein the plurality of dot-forming elements comprise:
a first dot-forming element sub-group; and
a second dot-forming element sub-group being located downstream from the first dot-forming element sub-group in the direction of the sub-scan, and the platen comprises a recessed portion arranged extending in the direction of the main scan at a location facing the second dot-forming element sub-group, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the method comprises the steps of:

(a) performing upper edge printing for forming dots in the upper edge portion in an upper edge portion sub-scan mode using the second dot-forming element sub-group and without using the first dot-forming element sub-group;

(b) performing intermediate printing for forming dots in the intermediate portion in an intermediate portion sub-scan mode using the first and second dot-forming element sub-groups, the intermediate portion sub-scan mode having a sub-scan maximum feed distance that is greater than a sub-scan maximum feed distance in the upper edge portion sub-scan mode; and (c) performing upper edge transition printing for forming dots in the upper edge transition portion in an upper edge transition portion sub-scan mode using the first and second dot-forming element sub-groups, the upper edge transition portion sub-scan mode having a sub-scan maximum feed distance that is smaller than the sub-scan maximum feed distance in the intermediate portion sub-scan mode.

12. A dot recording method according to claim 11 wherein the platen further comprises:

an upstream support portion for supporting the print medium, the upstream support portion extending in the direction of the main scan at a location facing the first dot-forming element sub-group; and a downstream support portion for supporting the print medium, the downstream support portion extending in the direction of the main scan at a location downstream from the recessed portion in the direction of the sub-scan.

13. A dot recording method according to claim 12 wherein the dot recording head comprises a third dot-forming element sub-group in the plurality of dot-forming elements, the third dot-forming element sub-group being located downstream from the second dot-forming element sub-group in the direction of the sub-scan and facing the downstream support portion, wherein the step (a) comprises the step of performing the upper edge printing without using the third dot-forming element sub-group, the step (c) comprises the step of performing the upper edge transition printing without using the third dot-forming element sub-group, and the step (b) comprises the step of performing the intermediate printing further using the third dot-forming element sub-group.

14. A dot recording method according to claim 11, wherein the upper edge transition portion sub-scan mode is equivalent to the upper edge portion sub-scan mode.

15. A dot recording method according to claim 11, wherein the step (a) comprises the step of performing the upper edge printing when the print medium is supported by the platen with the upper edge of the print medium located over an opening of the recessed portion.

16. A dot recording method for use in a dot recording device that records dots on a surface of a print medium supported on a platen using a dot recording head equipped with dot-forming element groups comprising a plurality of dot-forming elements for ejecting drops of ink, wherein main scanning is performed by driving the dot recording head and/or the print medium while driving at least part of the plurality of dot-forming elements to form dots, and sub-scanning is performed at intervals between the main scans by driving the print medium in a direction intersecting a direction of the main scan;

wherein the plurality of dot-forming elements comprise:
a first dot-forming element sub-group; and
a second dot-forming element sub-group being located downstream from the first dot-forming element sub-group in the direction of the sub-scan, and the platen comprises a recessed portion arranged extending in the direction of the main scan at a location facing the first dot-forming element sub-group, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the method comprises the steps of:

(a) performing intermediate printing for forming dots in the intermediate portion in an intermediate portion sub-scan mode using the first and second dot-forming element sub-groups;

(b) performing lower edge transition printing for forming dots in the lower edge transition portion in a lower edge transition portion sub-scan mode using the first and second dot-forming element sub-groups, the lower edge transition portion sub-scan mode having a sub-scan maximum feed distance that is smaller than a sub-scan maximum feed distance in the intermediate portion sub-scan mode; and (c) performing lower edge printing for forming dots in the lower edge portion in a lower edge portion sub-scan mode using the first dot-forming element sub-group and without using the second dot-forming element subgroup, the lower edge portion sub-scan mode having a sub-scan maximum feed distance that is smaller than the sub-scan maximum feed distance in the intermediate portion sub-scan mode.

17. A dot recording method according to claim 16, wherein the platen further comprises:

a downstream support portion for supporting the print medium, the downstream support portion extending in the direction of the main scan at a location facing the second dot-forming element sub-group; and an upstream support portion for supporting the print medium, the upstream support portion extending in the direction of the main scan at a location upstream from the recessed portion in the direction of the sub-scan.

18. A dot recording method according to claim 17, wherein the dot recording head comprises a third dot-forming element sub-group in the plurality of dot-forming elements, the third dot-forming element sub-group being located upstream from the first dot-forming element sub-group in the direction of the sub-scan and facing the upstream support portion, the step (a) comprises the step of performing the intermediate printing further using the third dot-forming element sub-group, the step (b) comprises the step of performing the lower edge transition printing without using the third dot-forming element sub-group, and the step (c) comprises the step of performing the lower edge printing without using the third dot-forming element sub-group.

19. A dot recording method according to claim 16, wherein the lower edge transition portion sub-scan mode is equivalent to the lower edge portion sub-scan mode.

20. A dot recording method according to claim 16, wherein the step (c) comprises the step of performing the lower edge printing when the print medium is supported by the platen with the lower edge of the print medium located over an opening of the recessed portion.

21. A computer program product for making a computer to form dots while performing main scan and to perform sub-scan at intervals between the main scans, the computer being connected with a dot recording device that records dots on a surface of a print medium supported on a platen using a dot recording head equipped with dot-forming element groups comprising a plurality of dot-forming elements for ejecting drops of ink, wherein the dot forming is performed by driving at least part of the plurality of dot-forming elements, the main scan is performed by driving the dot recording head and/or the print medium, and the sub-scan is performed by driving the print medium in a direction intersecting a direction of the main scan, wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the second dot-forming element sub-group, wherein the computer program product comprising:

a computer readable medium; and a computer program stored on the computer readable medium, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the computer program comprising:

a first sub-program for causing the computer to perform upper edge printing for forming dots in the upper edge portion in an upper edge portion sub-scan mode using the second dot-forming element sub-group and without using the first dot-forming element sub-group;

a second sub-program for causing the computer to perform intermediate printing for forming dots in the intermediate portion in an intermediate portion sub-scan mode using the first and second dot-forming element sub-groups, the intermediate portion sub-scan mode having a sub-scan maximum feed distance that is greater than a sub-scan maximum feed distance in the upper edge portion sub-scan mode; and a third sub-program for causing the computer to perform upper edge transition printing for forming dots in the upper edge transition portion in an upper edge transition portion sub-scan mode using the first and second dot-forming element sub-groups, the upper edge transition portion sub-scan mode having a sub-scan maximum feed distance that is smaller than the sub-scan maximum feed distance in the intermediate portion sub-scan mode.

22. A computer program product for making a computer to form dots while performing main scan and to perform sub-scan at intervals between the main scans, the computer being connected with a dot recording device that records dots on a surface of a print medium supported on a platen using a dot recording head equipped with dot-forming element groups comprising a plurality of dot-forming elements for ejecting drops of ink, wherein the dot forming is performed by driving at least part of the plurality of dot-forming elements, the main scan is performed by driving the dot recording head and/or the print medium, and the sub-scan is performed by driving the print medium in a direction intersecting a direction of the main scan, wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the first dot-forming element sub-group, wherein the computer program product comprising:

a computer readable medium; and a computer program stored on the computer readable medium, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the computer program comprising:

a first sub-program for causing the computer to perform intermediate printing for forming dots in the intermediate portion in an intermediate portion sub-scan mode using the first and second dot-forming element sub-groups;

a second sub-program for causing the computer to perform lower edge transition printing for forming dots in the lower edge transition portion in a lower edge transition portion sub-scan mode using the first and second dot-forming element sub-groups, the lower edge transition portion sub-scan mode having a sub-scan maximum feed distance that is smaller than a sub-scan maximum feed distance in the intermediate portion sub-scan mode; and a third sub-program for causing the computer to perform lower edge printing for forming dots in the lower edge portion in a lower edge portion sub-scan mode using the first dot-forming element sub-group and without using the second dot-forming element sub-group, the lower edge portion sub-scan mode having a sub-scan maximum feed distance that is smaller than the sub-scan maximum feed distance in the intermediate portion sub-scan mode.

23. A dot recording device for recording dots on a surface of a print medium using a dot recording head equipped with dot-forming element groups comprising a plurality of dot-forming elements for ejecting drops of ink, the device comprising:

a main scan drive unit which drives the dot recording head and/or the print medium to perform main scanning;

a head drive unit which drives at least part of the plurality of dot-forming elements to form dots during the main scan;

a platen arranged extending in a direction of the main scan so as to face the plurality of dot-forming elements in at least part of a path of the main scan, and supporting the print medium so as to face the dot recording head;

a sub-scan drive unit which drives at intervals between the main scans the print medium in a direction intersecting the direction of the main scan to perform sub-scanning; and a control unit for controlling the main scan drive unit, the head drive unit, and the sub-scan drive unit, wherein the plurality of dot-forming elements comprise:

a first dot-forming element sub-group; and a second dot-forming element sub-group being located downstream from the first dot-forming element sub-group in a direction of the sub-scan, and the platen comprises a recessed portion arranged extending in the direction of the main scan at a location facing the second dot-forming element sub-group, wherein the control unit includes an upper edge printing unit, and an intermediate printing unit, when it is assumed that the surface of the print medium is divided, in order from a top, into an upper edge portion that includes an upper edge, an upper edge transition portion, an intermediate portion, a lower edge transition portion, and a lower edge portion that includes a lower edge, the upper edge printing unit performs upper edge printing for forming dots in the upper edge portion in an upper edge portion sub-scan mode using the second dot-forming element sub-group and without using the first dot-forming element sub-group;

the intermediate printing unit performs intermediate printing for forming dots in the intermediate portion in an intermediate portion sub-scan mode using the first and second dot-forming element sub-groups, the intermediate portion sub-scan mode having a sub-scan maximum feed distance that is greater than a sub-scan maximum feed distance in the upper edge portion sub-scan mode.

24. A dot recording device for recording dots on a surface of a print medium using a dot recording head equipped with dot-forming element groups comprising a plurality of dot-forming elements for ejecting drops of ink, the device comprising:

a main scan drive unit which drives the dot recording head and/or the print medium to perform main scanning;

a head drive unit which drives at least part of the plurality of dot-forming elements to form dots during the main scan;

a platen arranged extending in a direction of the main scan so as to face the plurality of dot-forming elements in at least part of a path of the main scan, and supporting the print medium so as to face the dot recording head;

a sub-scan drive unit which drives at intervals between the main scans the print medium in a direction intersecting the direction of the main scan to perform sub-scanning; and a control unit for controlling the main scan drive unit, the head drive unit, and the sub-scan drive unit, wherein the plurality of dot-forming elements comprise:

a first dot-forming element sub-group; and a second dot-forming element sub-group being located downstream from the first dot-forming element sub-group in a direction of the sub-scan, and the platen comprises a recessed portion arranged extending in the direction of the main scan at a location facing the first dot-forming element sub-group, wherein the control unit includes an intermediate printing unit, and a lower edge printing unit, when it is assumed that the surface of the print medium is divided, in order from a top, into an upper edge portion that includes an upper edge, an upper edge transition portion, an intermediate portion, a lower edge transition portion, and a lower edge portion that includes a lower edge, the intermediate printing unit performs intermediate printing for forming dots in the intermediate portion in an intermediate portion sub-scan mode using the first and second dot-forming element sub-groups; and the lower edge printing unit performs lower edge printing for forming dots in the lower edge portion in a lower edge portion sub-scan mode using the first dot-forming element sub-group and without using the second dot-forming element sub-group, the lower edge portion sub-scan mode having a sub-scan maximum feed distance that is smaller than the sub-scan maximum feed distance in the intermediate portion sub-scan mode.

25. A dot recording method for use in a dot recording device that records dots on a surface of a print medium supported on a platen using a dot recording head equipped with dot-forming element groups comprising a plurality of dot-forming elements for ejecting drops of ink, wherein main scanning is performed by driving the dot recording head and/or the print medium while driving at least part of the plurality of dot-forming elements to form dots, and sub-scanning is performed at intervals between the main scans by driving the print medium in a direction intersecting a direction of the main scan;

wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the second dot-forming element sub-group, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the method comprises the steps of:

(a) performing upper edge printing for forming dots in the upper edge portion in an upper edge portion sub-scan mode using the second dot-forming element sub-group and without using the first dot-forming element sub-group; and (b) performing intermediate printing for forming dots in the intermediate portion in an intermediate portion sub-scan mode using the first and second dot-forming element sub-groups, the intermediate portion sub-scan mode.

26. A dot recording method for use in a dot recording device that records dots on a surface of a print medium supported on a platen using a dot recording head equipped with dot-forming element groups comprising a plurality of dot-forming elements for ejecting drops of ink, wherein main scanning is performed by driving the dot recording head and/or the print medium while driving at least part of the plurality of dot-forming elements to form dots, and sub-scanning is performed at intervals between the main scans by driving the print medium in a direction intersecting a direction of the main scan;

wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the first dot-forming element sub-group, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the method comprises the steps of:

(a) performing intermediate printing for forming dots in the intermediate portion in an intermediate portion sub-scan mode using the first and second dot-forming element sub-groups; and (b) performing lower edge printing for forming dots in the lower edge portion in a lower edge portion sub-scan mode using the first dot-forming element sub-group and without using the second dot-forming element sub-group, the lower edge portion sub-scan mode having a sub-scan maximum feed distance that is smaller than the sub-scan maximum feed distance in the intermediate portion sub-scan mode.

27. A computer program product for making a computer to form dots while performing main scan and to perform sub-scan at intervals between the main scans, the computer being connected with a dot recording device that records dots on a surface of a print medium supported on a platen using a dot recording head equipped with dot-forming element groups comprising a plurality of dot-forming elements for ejecting drops of ink, wherein the dot forming is performed by driving at least part of the plurality of dot-forming elements, the main scan is performed by driving the dot recording head and/or the print medium, and the sub-scan is performed by driving the print medium in a direction intersecting a direction of the main scan, wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the second dot-forming element sub-group, wherein the computer program product comprising:

a computer readable medium; and a computer program stored on the computer readable medium, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the computer program comprising:

a first sub-program for causing the computer to perform upper edge printing for forming dots in the upper edge portion in an upper edge portion sub-scan mode using the second dot-forming element sub-group and without using the first dot-forming element sub-group;

a second sub-program for causing the computer to preform intermediate printing for forming dots in the intermediate portion in an intermediate portion sub-scan mode using the first and second dot-forming element sub-groups, the intermediate portion sub-scan mode having a sub-scan maximum feed distance that is greater than a sub-scan maximum feed distance in the upper edge portion sub-scan mode.

28. A computer program product for making a computer to form dots while performing main scan and to perform sub-scan at intervals between the main scans, the computer being connected with a dot recording device that records dots on a surface of a print medium supported on a platen using a dot recording head equipped with dot-forming element groups comprising a plurality of dot-forming elements for ejecting drops of ink, wherein the dot forming is performed by driving at least part of the plurality of dot-forming elements, the main scan is performed by driving the dot recording head and/or the print medium, and the sub-scan is performed by driving the print medium in a direction intersecting a direction of the main scan, wherein the plurality of dot-forming elements comprise:

a first dot-forming element sub-group; and a second dot-forming element sub-group being located downstream from the first dot-forming element sub-group in the direction of the sub-scan, and the platen comprises a recessed portion arranged extending in the direction of the main scan at a location facing the first dot-forming element sub-group, wherein the computer program product comprising:

a computer readable medium; and a computer program stored on the computer readable medium, when it is assumed that the surface of the print medium is divided, in order from a top, into an upper edge portion that includes an upper edge, an upper edge transition portion, an intermediate portion, a lower edge transition portion, and a lower edge portion that includes a lower edge, and the computer program comprising:

a first sub-program for causing the computer to perform intermediate printing for forming dots in the intermediate portion in an intermediate portion sub-scan mode using the first and second dot-forming element sub-group; and a second sub-program for causing the computer to perform lower edge printing for forming dots in the lower edge portion in a lower edge portion sub-scan mode using the first dot-forming element sub-group and without using the second dot-forming element sub-group, the lower edge portion sub-scan mode having a sub-scan maximum feed distance that is smaller than the sub-scan maximum feed distance in the intermediate portion sub-scan mode.

* * * * *